US007447325B2

(12) United States Patent
Bren et al.

(10) Patent No.: US 7,447,325 B2
(45) **Date of Patent: *Nov. 4, 2008**

(54) SYSTEM AND METHOD FOR SELECTIVELY COUPLING HEARING AIDS TO ELECTROMAGNETIC SIGNALS

(75) Inventors: Mark A. Bren, Loretto, MN (US); Timothy S. Peterson, Lino Lakes, MN (US); Randall W. Roberts, Eden Prairie, MN (US); Blane Anderson, Burnsville, MN (US); Mike K. Sacha, Chanhassen, MN (US)

(73) Assignee: Micro Ear Technology, Inc., Plymouth, MN (US)

( * ) Notice: Subject to any disclaimer, the term of this patent is extended or adjusted under 35 U.S.C. 154(b) by 713 days.

This patent is subject to a terminal disclaimer.

(21) Appl. No.: 10/243,412

(22) Filed: Sep. 12, 2002

(65) Prior Publication Data

US 2004/0052391 A1 Mar. 18, 2004

(51) Int. Cl.
*H04R 25/00* (2006.01)

(52) U.S. Cl. ..... 381/331; 381/312; 381/315

(58) Field of Classification Search ..... 381/312, 381/314–315, 324, 327–328, 331, 23.1
See application file for complete search history.

(56) References Cited

U.S. PATENT DOCUMENTS

| | | | | |
|---|---|---|---|---|
| 2,530,621 | A | 11/1950 | Lybarger | 179/107 |
| 2,554,834 | A | 5/1951 | Lavery | 179/107 |
| 2,656,421 | A | 10/1953 | Lybarger | 179/107 |
| 3,396,245 | A | 8/1968 | Flygstad | 179/107 |
| 3,660,695 | A | 5/1972 | Schmitt | |
| 4,187,413 | A | 2/1980 | Moser | 179/107 |
| 4,395,601 | A | 7/1983 | Kopke et al. | |

(Continued)

FOREIGN PATENT DOCUMENTS

| | | | |
|---|---|---|---|
| CH | 670349 | | 5/1989 |
| DE | 2510731 | | 9/1976 |
| DE | 101 46 886.5 | * | 9/2001 |
| EP | 0941014 A2 | | 9/1999 |
| EP | 0989775 A1 | | 3/2000 |

(Continued)

OTHER PUBLICATIONS

Hansaton Akustik GMBH, "48 K-AMP Contactmatic", (*from Service Manual*), (Apr. 1996), 8 pgs.

(Continued)

*Primary Examiner*—Curtis Kuntz
*Assistant Examiner*—Phylesha L Dabney
(74) *Attorney, Agent, or Firm*—Schwegman, Lundberg & Woessner, P.A.

(57) ABSTRACT

Systems, devices and methods are provided for selectively coupling hearing aids to electromagnetic fields. One aspect relates to a hearing aid device. In various embodiments, the hearing aid device includes an induction signal receiver for receiving induction signals, a microphone system for receiving acoustic signals, a hearing aid receiver, and a signal processing circuit. The signal processing circuit includes a proximity sensor for detecting an induction source. The signal processing circuit presents a first signal to the hearing aid receiver that is representative of the acoustic signals. When the induction source is detected, the signal processing circuit presents a second signal to the hearing aid receiver that is representative of the induction signals and transmits a third signal representative of the induction signals from the hearing aid device to a second hearing aid device. Other aspects are provided herein.

51 Claims, 12 Drawing Sheets

U.S. PATENT DOCUMENTS 4,425,481 A 1/1984 Mansgold et al.
4,467,145 A 8/1984 Borstel
4,489,330 A 12/1984 Marutake et al.
4,490,585 A 12/1984 Tanaka ..... 179/107
4,508,940 A 4/1985 Steeger ..... 179/107
4,596,899 A 6/1986 Wojcik et al.
4,631,419 A 12/1986 Sadamatsu et al.
4,638,125 A 1/1987 Buettner ..... 381/68.4
4,696,032 A 9/1987 Levy
4,710,961 A 12/1987 Buttner ..... 381/68.7
4,756,312 A 7/1988 Epley
4,764,957 A 8/1988 Angelini et al. ..... 379/433
4,845,755 A 7/1989 Busch et al. ..... 381/68
4,862,509 A 8/1989 Towsend
4,887,299 A 12/1989 Cummins et al. ..... 381/68.4
4,926,464 A 5/1990 Schley-May ..... 379/99
4,930,156 A 5/1990 Norris
4,995,085 A 2/1991 Kern et al.
5,010,575 A 4/1991 Marutake et al. ..... 381/68
5,027,410 A 6/1991 Williamson et al.
5,086,464 A 2/1992 Groppe ..... 379/430
5,091,952 A 2/1992 Williamson et al.
5,189,704 A 2/1993 Krauss ..... 381/68.4
5,212,827 A 5/1993 Meszko et al.
5,280,524 A 1/1994 Norris
5,404,407 A 4/1995 Weiss ..... 381/68
5,422,628 A 6/1995 Rodgers ..... 340/573
5,425,104 A 6/1995 Shennib ..... 381/68
5,463,692 A 10/1995 Fackler ..... 381/68
5,479,522 A 12/1995 Lindemann et al.
5,524,056 A 6/1996 Killion et al. ..... 381/68.2
5,553,152 A 9/1996 Newton ..... 381/68.6
5,600,728 A 2/1997 Satre ..... 381/68.2
5,629,985 A 5/1997 Thompson
5,636,285 A 6/1997 Sauer
5,640,293 A 6/1997 Dawes et al. ..... 361/93
5,640,457 A 6/1997 Gnecco et al.
5,659,621 A 8/1997 Newton ..... 381/68
5,687,242 A 11/1997 Iburg
5,706,351 A 1/1998 Weinfurtner ..... 381/68.2
5,710,820 A 1/1998 Martin et al. ..... 381/68.4
5,721,783 A 2/1998 Anderson ..... 381/328
5,737,430 A 4/1998 Widrow
5,740,257 A 4/1998 Marcus
5,751,820 A 5/1998 Taenzer ..... 381/68
5,757,932 A 5/1998 Lindemann et al. ..... 381/68
5,757,933 A 5/1998 Preves et al. ..... 381/68
5,768,397 A 6/1998 Fazio ..... 381/68
5,796,848 A 8/1998 Martin ..... 381/68.2
5,809,151 A 9/1998 Husung ..... 381/69
5,823,610 A 10/1998 Ryan et al.
5,835,610 A 11/1998 Ishige et al.
5,991,419 A 11/1999 Brander ..... 381/312
5,991,420 A 11/1999 Stern ..... 381/315
6,031,922 A 2/2000 Tibbetts
6,031,923 A 2/2000 Gnecco et al.
6,078,675 A 6/2000 Bowen-Nielsen et al. ... 381/331
6,101,258 A 8/2000 Killion et al.
6,104,821 A 8/2000 Husung ..... 381/312
6,115,478 A 9/2000 Schneider
6,118,877 A 9/2000 Lindemann et al.
6,148,087 A 11/2000 Martin ..... 381/327
6,157,727 A 12/2000 Rueda ..... 381/312
6,157,728 A 12/2000 Tong et al.
6,175,633 B1 1/2001 Morrill et al. ..... 381/71.6
6,216,040 B1 4/2001 Harrison
6,240,194 B1 * 5/2001 De Koning ..... 381/315
6,310,556 B1 10/2001 Green et al. ..... 340/636
6,324,291 B1 11/2001 Weidner ..... 381/322
6,327,370 B1 12/2001 Killion et al.
6,356,741 B1 3/2002 Bilotti et al.
6,381,308 B1 4/2002 Cargo et al.
6,459,882 B1 10/2002 Palermo et al.
6,466,679 B1 10/2002 Husung
6,522,764 B1 2/2003 Bogeskov-Jensen
6,549,633 B1 * 4/2003 Westermann ..... 381/312
6,633,645 B2 10/2003 Bren et al.
6,760,457 B1 7/2004 Bren et al.
7,016,511 B1 3/2006 Shennib
7,162,381 B2 1/2007 Boor et al.
7,248,713 B2 7/2007 Bren et al.
7,317,997 B2 1/2008 Boor et al.
7,369,669 B2 5/2008 Hagen et al.
2002/0076073 A1 6/2002 Taenzer et al.
2002/0186857 A1 12/2002 Bren et al.
2003/0059073 A1 3/2003 Bren et al.
2003/0059076 A1 * 3/2003 Martin ..... 381/331
2004/0052391 A1 3/2004 Bren et al.
2004/0052392 A1 3/2004 Sacha et al.
2006/0013420 A1 1/2006 Sacha
2007/0121975 A1 5/2007 Sacha et al.
2007/0248237 A1 10/2007 Bren et al.
2008/0013769 A1 1/2008 Sacha et al.

FOREIGN PATENT DOCUMENTS

EP 1196008 A2 4/2002
EP 1398995 A2 3/2004
EP 1174003 B1 7/2004
EP 1484942 A2 12/2004
WO WO-02/23950 A2 3/2002
WO WO-2006078586 A2 7/2006

OTHER PUBLICATIONS

Schaefer, Conrad, "Letter referencing Micro Ear Patent", (Aug. 22, 2002),2 pgs.
Lacanette, K., "A Basic Introduction to Filters—Active, Passive, and Switched-Capacitor", *National Semiconductor Corporation*, http://www.swarthmore.edu/NatSci/echeeve1/Ref/DataSheet/Inttofilters.pdf,(Apr. 1991).
Beck, L..B. ,"The "T" Switch; Some Tips for Effective Use", *Shhh*, (Jan./Feb. 1989),pp. 12-15.
Gilmore, R..,"Telecoils: past, present & future", *Hearing Instruments*, 44 (2), (1993),pp. 22, 26-27, 40.
Lybarger, S..F. ,"Development of a New Hearing Aid with Magnetic Microphone", *Electrical Manufacturing*, (Nov. 1947),11 pages.
Preves, D..A. ,"A Look at the Telecoil—It's Development and Potential", *SHHH Journal*, (Sep./Oct. 1994),pp. 7-10.
"European Search Report for corresponding European Patent Application EP 03255714", (Mar. 23, 2007), 3 pgs.
Davis, A. , et al., "Magnitude of Diotic Summation in Speech-in-Noise Tasks:Performance Region and Appropriate Baseline", *British Journal of Audiology*, 24, (1990),11-16.
Halverson, H. M., "Diotic Tonal Volumes as a Function of Difference of Phase", *The American Journal of Psychology*, 33(4), (Oct. 1922),526-534.
Preves, David A., "Field Trial Evaluations of a Switched Directional/Omnidirectional In-the-Ear Hearing Instrument", *Journal of the American Academy of Audiology*, 10(5), (May 1999),273-283.
Teder, Harry , "Something New In CROS", *Hearing Instruments*, vol. 27, No. 9, Published by Harcourt Brace Jovanovich,(Sep. 1976),pp. 18-19.
Zelnick, E. , "The Importance of Interaural Auditory Differences in Binaural Hearing", *In: Binaural Hearing and Amplification*, vol. 1, Libby, E. R., Editor, Zenetron, Inc., Chicago, IL,(1980),81-103.
U.S. Appl. No. 10/244,295 Non Final Office Action mailed Feb. 3, 2006, 10 pgs.
U.S. Appl. No. 09/659,214 Advisory Action mailed Jun. 2, 2003, 3 pgs.
U.S. Appl. No. 09/659,214 Final Office Action mailed Feb. 14, 2003, 8 pgs.
U.S. Appl. No. 09/659,214 Final Office Action mailed Mar. 19, 2003, 7 pgs.

U.S. Appl. No. 09/659,214 Non Final Office Action mailed Jul. 18, 2003, 8 pgs.
U.S. Appl. No. 09/659,214 Non Final Office Action mailed Sep. 6, 2002, 8 pgs.
U.S. Appl. No. 09/659,214 Notice of Allowance mailed Feb. 10, 2004, 6 pgs.
U.S. Appl. No. 09/659,214 Response filed May 19, 2003 to Final Office Action mailed Mar. 19, 2003, 9 pgs.
U.S. Appl. No. 09/659,214 Response filed Oct. 24, 2003 to Non Final Office Action mailed Jul. 18, 2003, 9 pgs.
U.S. Appl. No. 09/659,214 Response filed Nov. 12, 2002 to Non Final Office Action mailed Sep. 6, 2002, 7 pgs.
U.S. Appl. No. 10/244,295 Final Office Action mailed Aug. 11, 2006, 9 pgs.
U.S. Appl. No. 10/244,295 Non-Final Office Action mailed Nov. 29, 2006, 12 pgs.
U.S. Appl. No. 10/244,295 non-final office action mailed Mar. 11, 2005, 9 pgs.
U.S. Appl. No. 10/244,295 Response filed Oct. 11, 2006 final office action mailed Aug. 11, 2006, 17 pgs.
U.S. Appl. No. 10/214,045 Amendment Under 37 CFR 1.312 filed Jun. 9, 2003, 6 pgs.
U.S. Appl. No. 10/214,045 Non Final Office Action mailed Dec. 2, 2002, 12 pgs.
U.S. Appl. No. 10/214,045 Notice of Allowance mailed Apr. 8, 2003, 20 pgs.
U.S. Appl. No. 10/214,045 Response filed Apr. 2, 2002 to Non Final Office Action mailed Dec. 2, 2002, 8 pgs.
U.S. Appl. No. 10/244,295 Notice of Allowance Aug. 7, 2007, 5 pgs.
U.S. Appl. No. 10/244,295 Final Office Action mailed May 24, 2007, 11 pgs.
U.S. Appl. No. 10/244,295 Non-Final Office Action mailed Mar. 11, 2005, 10 pgs.
U.S. Appl. No. 10/244,295 Notice of Allowance mailed Aug. 7, 2007, 7 pgs.
U.S. Appl. No. 10/244,295 Response filed Feb. 28, 2007 to Non-Final Office Action mailed Nov. 29, 2006, 16 pgs.
U.S. Appl. No. 10/244,295 Response filed May 3, 2006 to Non-Final Office Action mailed Feb. 3, 2006, 17 pgs.
U.S. Appl. No. 10/244,295 Response filed Jun. 13, 2005 to Non-Final Office Action mailed Mar. 11, 2005, 20 pgs.
U.S. Appl. No. 10/244,295 Response filed Jul. 24, 2007 to Final Office Action mailed May 24, 2007, 12 pgs.
U.S. Appl. No. 10/284,877 Final Office Action mailed Jun. 14, 2006, 13 pgs.
U.S. Appl. No. 10/284,877 Final Office Action mailed Nov. 14, 2006, 11 pgs.
U.S. Appl. No. 10/284,877 Non Final Office Action mailed Mar. 25, 2005, 9 pgs.
U.S. Appl. No. 10/284,877 Non Final Office Action mailed Dec. 1, 2005, 11 pgs.
U.S. Appl. No. 10/284,877 Notice of Allowance mailed Mar. 22, 2007, 7 pgs.
U.S. Appl. No. 10/284,877 Response filed Mar. 1, 2006 to Non Final Office Action mailed Dec. 1, 2005, 17 pgs.
U.S. Appl. No. 10/284,877 Response filed Mar. 14, 2007 to Final Office Action mailed Nov. 14, 2006, 8 pgs.
U.S. Appl. No. 10/284,877 Response filed Jun. 27, 2005 to Non Final Office Action mailed Mar. 25, 2005, 15 pgs.
U.S. Appl. No. 10/284,877 Response filed Oct. 16, 2006 to Final Office Action mailed Jun. 14, 2006, 16 pgs.

* cited by examiner

SYSTEM AND METHOD FOR SELECTIVELY COUPLING HEARING AIDS TO ELECTROMAGNETIC SIGNALS

CROSS REFERENCE TO RELATED APPLICATIONS

This application is related to the following commonly assigned U.S. patent applications which are herein incorporated by reference in their entirety: "Automatic Switch for Hearing Aid," Ser. No. 09/659,214, filed on Sep. 11, 2000; "Diotic Presentation of Second-Order Gradient Directional Hearing Aid Signals," Ser. No. 10/146,536, filed on May 15, 2002; and "Switching Structures For Hearing Aid," Ser. No. 10/244,295, filed on Sep. 16, 2002.

TECHNICAL FIELD

This application relates generally to hearing aid systems and, more particularly, to systems, devices and methods for selectively coupling hearing aids to electromagnetic signals.

BACKGROUND

Some hearing aids provide adjustable operational modes or characteristics that improve the performance of the hearing aid for a specific person or in a specific environment. Some of the operational characteristics are on/off, volume control, tone control, and selective signal input. One way to control these characteristics is by a manually engagable switch on the hearing aid.

Some hearing aids include both a non-directional microphone and a directional microphone in a single hearing aid. When a person is talking to someone in a crowded room the hearing aid can be switched to the directional microphone in an attempt to directionally focus the reception of the hearing aid and prevent amplification of unwanted sounds from the surrounding environment. Some hearing aids include a manually-actuated switch. Actuation of these switches can be inconvenient and difficult, especially for those with impaired finger dexterity.

The volume for some hearing aids is adjusted using magnetically activated switches that are controlled by holding magnetic actuators adjacent to the hearing aids. Actuation of these switches can be inconvenient because a person is required to have the magnetic actuator available to change the volume.

With respect to telephone use, some hearing aids have an input which receives the electromagnetic voice signal directly from the voice coil of a telephone instead of receiving the acoustic signal emanating from the telephone speaker. Conventionally, a telephone handset provides an electromagnetic voice signal to only one ear. Thus, only a single hearing aid of a two hearing aid system is in use with a telephone handset. Moreover, the hearing aid that is not receiving the signal from the telephone handset continues to amplify signals from the surrounding environment that may interfere with the wearer's ability to hear the desired telephone signal.

There is a need in the art to provide improved systems, devices and methods for providing improved systems and methods for selectively coupling hearing aids to electromagnetic fields such as that produced by telephone coils.

SUMMARY

The above mentioned problems are addressed by the present subject matter and will be understood by reading and studying the following specification. The present subject matter provides improved systems, devices and methods for selectively coupling hearing aids to electromagnetic signals. In various embodiments, the present subject matter provides improved coupling to electromagnetic signals from telephone receivers.

One aspect relates to a hearing aid device. In various embodiments, the hearing aid device includes an induction signal receiver for receiving induction signals, a microphone system for receiving acoustic signals, a hearing aid receiver, and a signal processing circuit operably connected to the induction signal receiver, the microphone system, and the hearing aid receiver. The signal processing circuit includes a proximity sensor, such as a magnetic sensor, for detecting an induction source, such as a telephone voice coil, for example. The signal processing circuit presents a first signal to the hearing aid receiver that is representative of the acoustic signals. When the induction source is detected, the signal processing circuit presents a second signal to the hearing aid receiver that is representative of the induction signals and transmits a third signal representative of the induction signals from the hearing aid device to a second hearing aid device.

In various embodiments, the hearing aid device includes an induction signal receiver for receiving induction signals, a microphone system for receiving acoustic signals, a hearing aid receiver, and a signal processing circuit operably connected to the induction signal receiver, the microphone system, and the hearing aid receiver. The signal processing circuit has an acoustic operational state to present a first signal to the hearing aid receiver that is representative of the acoustic signals, and an induction operational state to present a second signal to the hearing aid receiver that is representative of the induction signals. In the induction operational state, the signal processing circuit transmits a third signal representative of the induction signals from the hearing aid device to a second hearing aid device.

According to various embodiments, the hearing aid device forms a first hearing aid device in a system that also includes a second hearing aid device. The second hearing aid device includes a microphone system for receiving acoustic signals, a hearing aid receiver, and a signal processing circuit operably connected to the microphone system and the hearing aid receiver. The signal processing circuit of the second hearing aid device has an acoustic operational state to present a fourth signal to the hearing aid receiver that is representative of the acoustic signals, and an induction operational state to receive the transmitted third signal from the first hearing aid device representative of the induction signals. In the induction operational state, the signal processing circuit of the second hearing aid device presents a fifth signal to the hearing aid receiver that is representative of the induction signals.

One aspect relates to a method for selectively coupling a hearing aid system to induction signals produced by an induction source, such as a telephone voice coil, for example. In various embodiments, a first signal representative of acoustic signals is presented to a first hearing aid receiver in a first hearing aid device to assist with hearing in a first ear. An induction field source is detected. Upon the detection of the induction field source, a second signal representative of induction signals from the induction field source is presented to the first hearing aid receiver to assist hearing in the first ear, and a third signal representative of the induction signals is transmitted to a second hearing aid device to assist hearing in a second ear. According to various embodiments, the second signal and the third signal are used to diotically present acoustic representative of the induction signals to a wearer.

These and other aspects, embodiments, advantages, and features will become apparent from the following description and the referenced drawings.

DETAILED DESCRIPTION

Figure 1:
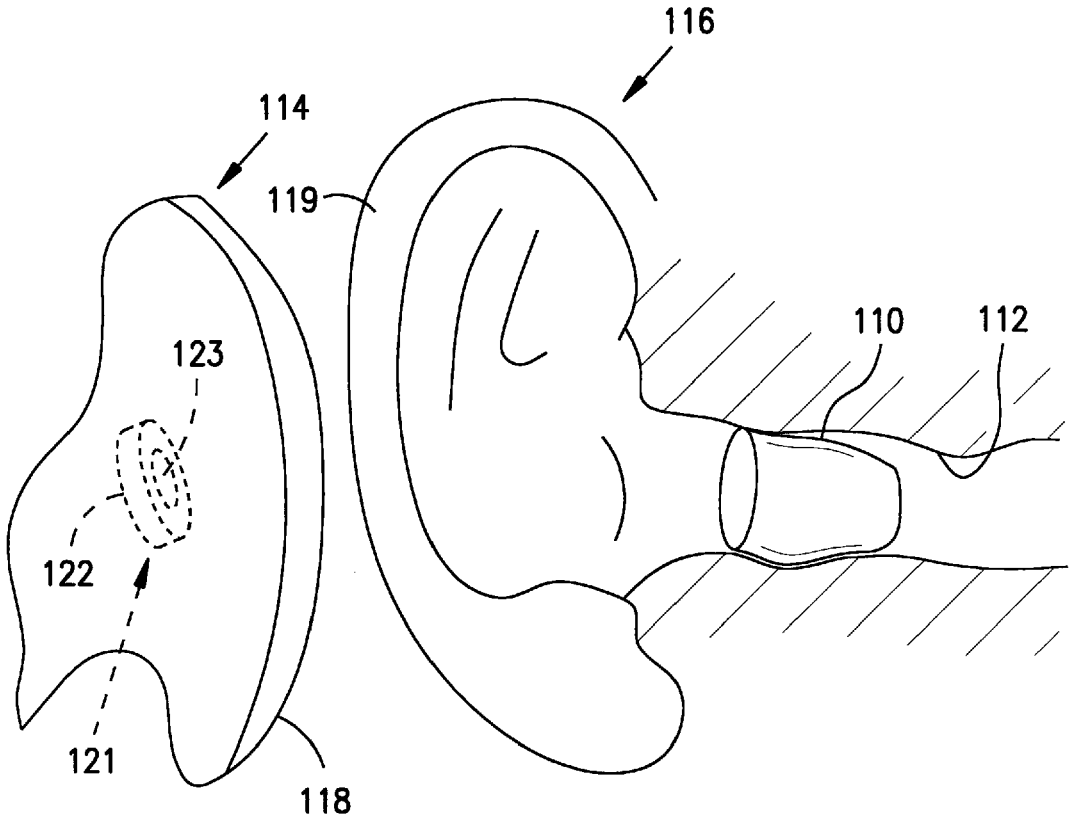
FIG. 1 illustrates a hearing aid device, according to various embodiments of the present subject matter, adjacent to a magnetic field source.

The following detailed description of the present subject matter refers to the accompanying drawings which show, by way of illustration, specific aspects and embodiments in which the present subject matter may be practiced. In the drawings, like numerals describe substantially similar components throughout the several views. These embodiments are described in sufficient detail to enable those skilled in the art to practice the present subject matter. Other embodiments may be utilized and structural, logical, and electrical changes may be made without departing from the scope of the present subject matter. The following detailed description is, therefore, not to be taken in a limiting sense, and the scope of the present subject matter is defined only by the appended claims, along with the full scope of equivalents to which such claims are entitled.

FIG. 1 illustrates a hearing aid device, according to various embodiments of the present subject matter, adjacent to a magnetic field source. The illustrated hearing aid device is an in-the-ear hearing aid 110 that is positioned completely in the ear canal 112. The present subject matter is not so limited, however. A telephone handset 114 is positioned adjacent the ear 116 and, more particularly, the speaker 118 of the handset is adjacent the pinna 119 of ear 116. Speaker 118 includes an electromagnetic transducer 121 which includes a permanent magnet 122 and a voice coil 123 fixed to a speaker cone (not shown). Briefly, the voice coil 123 receives the time-varying component of the electrical voice signal and moves relative to the stationary magnet 122. The speaker cone moves with coil 123 and creates an acoustic pressure wave ("acoustic signal"). It has been found that when a person wearing a hearing aid uses a telephone it is more efficient for the hearing aid 110 to pick up the voice signal from the magnetic field gradient produced by the voice coil 123 and not the acoustic signal produced by the speaker cone. Advantages associated with receiving the voice signal directly from the telecoil include blocking out environmental noise and eliminating acoustic feedback from the receiver.

Figure 2:
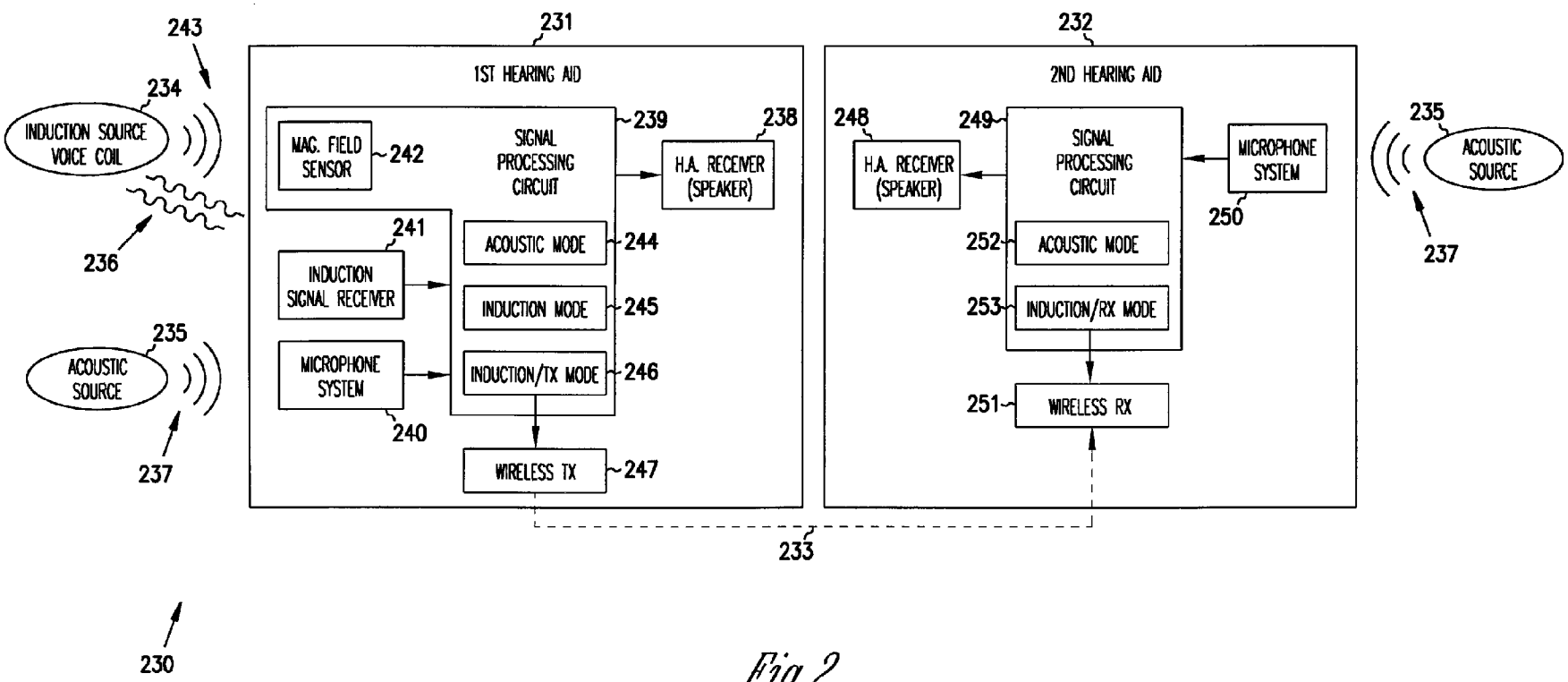
FIG. 2 illustrates a hearing aid system according to a wireless embodiment of the present subject matter.

FIG. 2 illustrates a hearing aid system according to a wireless embodiment of the present subject matter. The hearing aid system 230 includes a first hearing aid device 231 and a second hearing aid device 232. A wearer is capable of wearing the first hearing aid device 231 to aid hearing in a first ear, and the second hearing aid device 232 to aid hearing in a second ear. In the illustrated embodiment, the first hearing aid device 231 is adapted to wirelessly transmit a signal (as illustrated via 233) and the second hearing aid device 232 is adapted to wirelessly receive the signal. According to various embodiments, the wireless communication used in the present subject matter includes radio frequency (RF) communication, infrared communication, ultrasonic communication, and inductive communication. However, one of ordinary skill in the art will understand that the present subject matter is capable of using other wireless communication technology, whether now known or hereafter developed. Thus, the present subject matter is not so limited to a particular wireless communication technology.

The environment of the illustrated system 230 includes an induction source 234 and an acoustic source 235. One example of an induction source is a telephone voice coil such as that found in the telephone handset. Other examples of induction sources include, but are not limited to, inductive loop assistive listening systems such as a loop of wire around a room or around a wearer's neck The induction source 234 provides an induction signal 236 and a magnetic field gradient. The acoustic source 235 provides an acoustic signal 237.

In the illustrated embodiment, the first hearing aid device 231 includes a hearing aid receiver 238 (or speaker), a signal processing circuit 239, an microphone system 240, and induction signal receiver 241. According to various embodiments, the signal processing circuit 239 includes a proximity sensor such as a magnetic field sensor 242. The microphone system 240 is capable of detecting the acoustic signal 237 and providing a representative signal to the signal processing circuit 239. The induction signal receiver 241 is capable of detecting the induction signal 236 and providing a representative signal to the signal processing circuit 239. The sensor 242 detects when the first hearing aid is proximate to or within range of the induction source. In one embodiment, a magnetic field sensor 242 detects a magnetic field gradient 243 such as that produced by a permanent magnet 122 in a telephone handset, as illustrated in FIG. 1.

In various embodiments, sensor 242 includes a reed switch. In various embodiments, sensor 242 includes a solid state switch. In various embodiments, solid state switch 242 includes a MAGFET. In various embodiments, the solid state switch 242 is a giant magneto resistive switch. In various embodiments, the solid state switch 242 is an anisotropic resistive switch. In various embodiments, the solid state switch 242 is a spin dependent tunneling switch. In various embodiments, the solid state switch 242 is a Hall Effect switch.

The signal processing circuit 239 provides various signal processing functions which, according to various embodiments, include noise reduction, amplification, frequency response, and/or tone control. In various embodiments, the signal processing circuit 239 includes an acoustic mode 244, an induction mode 245 and a transmitter (induction/TX) mode 246. These modes can be viewed as operational states. In various embodiments, the acoustic mode 244 is the default mode for the signal processing circuit 239. In the acoustic mode 244, the signal processing circuit 239 receives a signal from the microphone system 240 and presents a representative signal to the hearing aid receiver 238 to transmit acoustic signals into a wearer's ear. In the induction mode 245, the signal processing circuit 239 receives a signal from the induction signal receiver 241 and presents a representative signal to the hearing aid receiver 238 to transmit acoustic signals into a wearer's ear. In the induction/TX mode 246, the signal processing circuit 239 receives a signal from the induction signal receiver 241 and presents a representative signal to a wireless transmitter 247 to wirelessly transmit a representative signal to the second hearing aid device 232. In various embodiments, the induction mode 245 and the induction/TX mode 246 function together as a single operational state. As is explained in more detail below, the second hearing aid device receives the wirelessly transmitted signal such that a signal representative of the induction signal 236 is diotically presented to the wearer using the first and second hearing aid devices 231 and 232.

According to various embodiments, the magnetic field sensor 242 automatically switches the signal processing circuit 239 among the available modes of operation. In various embodiments, the magnetic field sensor 242 automatically switches the signal processing circuit 239 from an acoustic mode 244 to both the induction mode 245 and the induction/TX mode 239. In these embodiments, the induction mode 245 and the induction/TX mode 239 function together as a single mode which functions mutually exclusively with respect to the acoustic mode 244.

In the illustrated embodiment, the second hearing aid device 232 includes a hearing aid receiver 248 (or speaker), a signal processing circuit 249, a microphone system 250, and a wireless receiver 251. The microphone system 250 is capable of detecting the acoustic signal 237 and providing a representative signal to the signal processing circuit 249.

The signal processing circuit 249 provides various signal processing functions which, according to various embodiments, include noise reduction, amplification, frequency response shaping, and/or compression. In various embodiments, the signal processing circuit 249 includes an acoustic mode 252, and a receiver (induction/RX) mode 253. In various embodiments, the acoustic mode 252 is the default mode for the signal processing circuit 249. In the acoustic mode 252, the signal processing circuit 249 receives a signal from the microphone system 250 and presents a representative signal to the hearing aid receiver 248 to transmit acoustic signals into a wearer's ear. In the induction/RX mode 253, the signal processing circuit 249 receives wirelessly transmitted signal 233 from the first hearing aid device 231 via the wireless receiver 251 and presents a representative signal to the hearing aid receiver 248. Thus, the illustrated system 230 diotically presents a signal representative of the induction signal 236 to the wearer using the first and second hearing aid devices 231 and 232.

According to various embodiments, the signal processing circuit 249 automatically switches among the available modes of operation. In various embodiments, the signal processing circuit 249 automatically switches from the acoustic mode 252 to both the induction/RX mode 253 when signal 233 is present. In these embodiments, the induction/RX mode 253 function and acoustic mode 252 are mutually exclusive.

In various embodiments, the wireless transmitter 247 includes an RF transmitter and the wireless receiver 251 includes an RF receiver. In various embodiments, the wireless transmitter 247 includes a tuned circuit to transmit an inductively transmitted signal, and the wireless receiver 251 includes an amplitude modulated receiver to receive the inductively transmitted signal.

Figure 3:
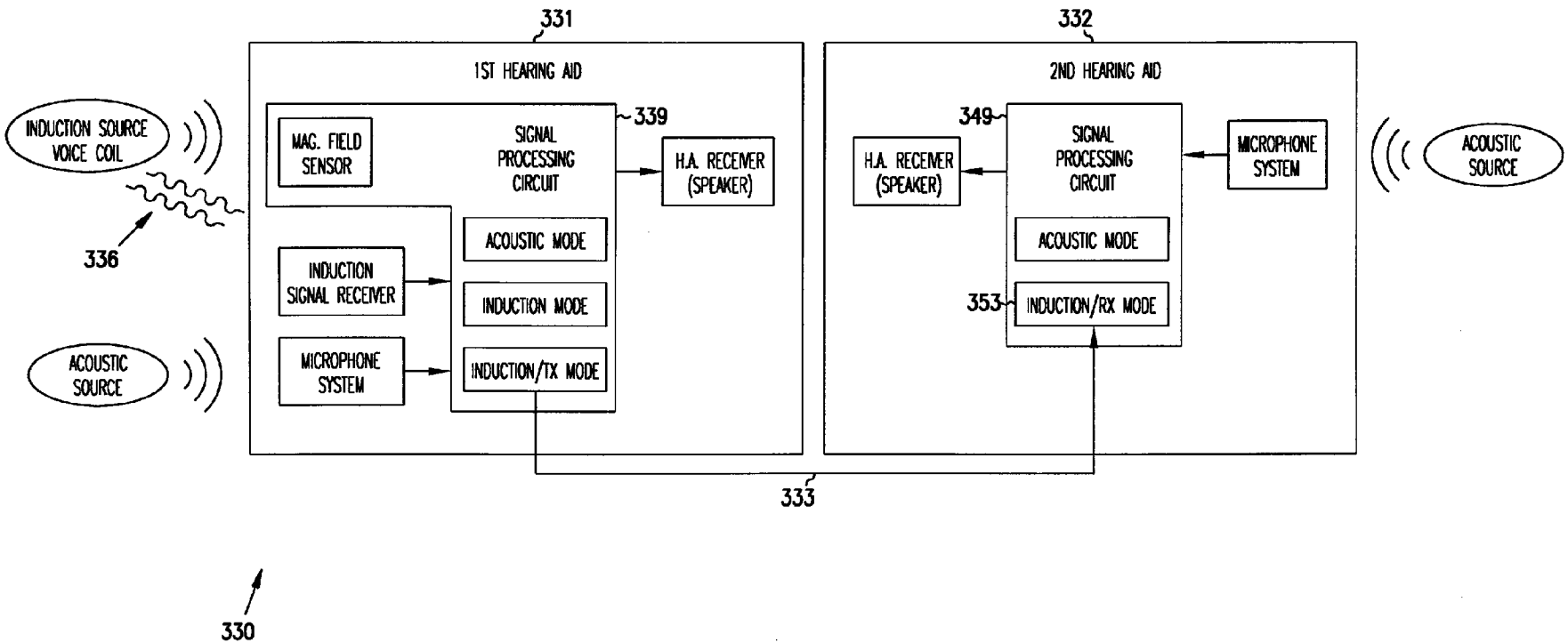
FIG. 3 illustrates a hearing aid system according to various embodiments of the present subject matter.

FIG. 3 illustrates a hearing aid system according to various embodiments of the present subject matter. The hearing aid system 330 of FIG. 3 is generally similar to the hearing aid system 230 of FIG. 2. In the illustrated hearing aid system 330, when the signal processing circuit 339 in the first hearing aid device 331 is operating in the induction/TX mode 246, the circuit 339 transmits a signal 333 representative of the induction signals 336 to the second hearing aid device 332 via wired media. In various embodiments, the wire media includes, but is not limited to, conductive media in neckless, glasses, and devices that extend a conductive media between the first and second hearing aids. In the illustrated hearing aid system 330, when the signal processing circuit 349 in the second hearing aid device 332 is operating in the induction/RX mode 353, the circuit 349 receives the signal 333 representative of the induction signals 336 from the first hearing aid device 331.

Figure 4:
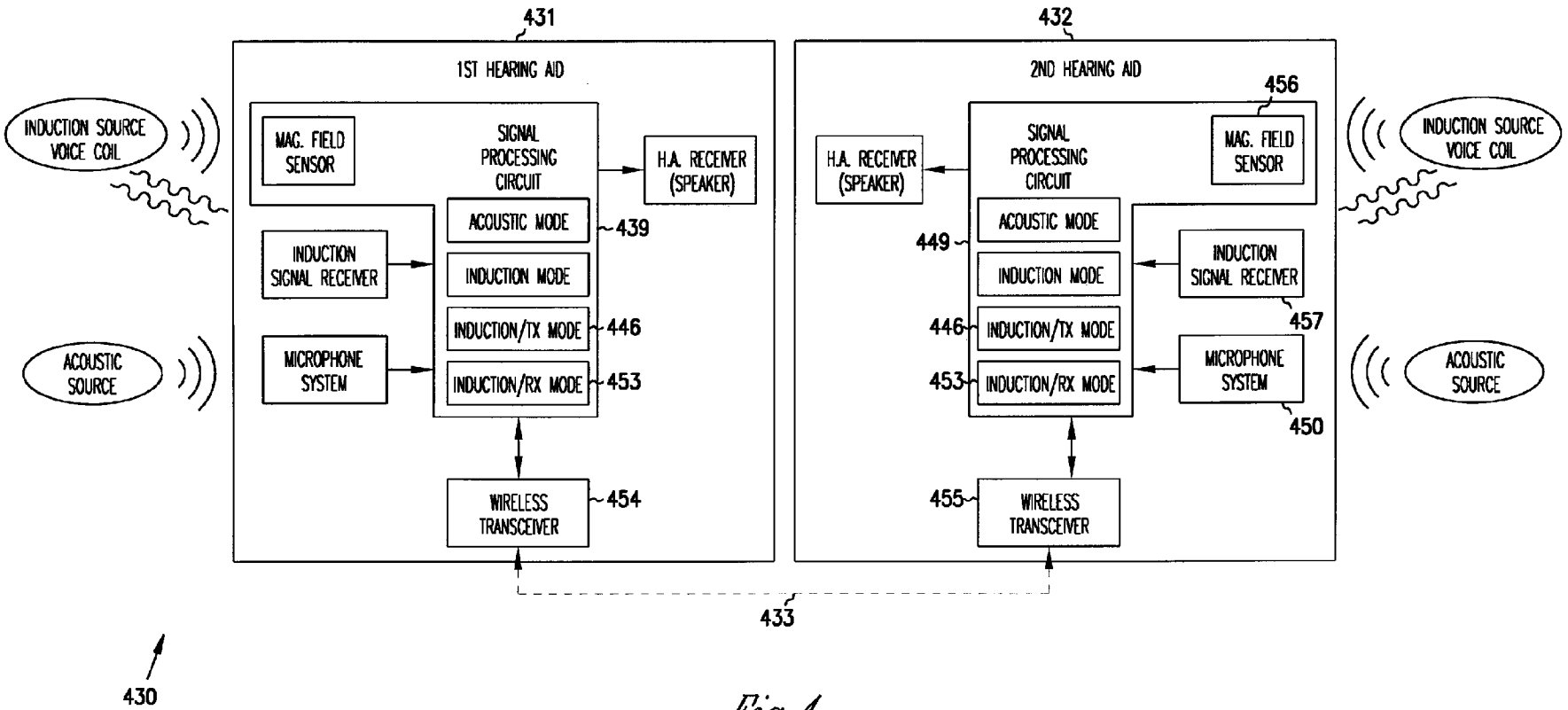
FIG. 4 illustrates a hearing aid system according to a wireless embodiment of the present subject matter.

FIG. 4 illustrates a hearing aid system according to a wireless embodiment of the present subject matter. The hearing aid system 430 of FIG. 4 is generally similar to the hearing aid system 230 of FIG. 2 and the hearing aid system 330 of FIG. 3. In the illustrated hearing aid system 430, the first hearing aid device 431 includes a wireless transceiver 454 and the second hearing aid device 432 includes a wireless transceiver 455, a magnetic field sensor 456, an induction signal receiver 457 and the microphone system 450. Additionally, both the signal processing circuit 439 and the signal processing circuit 449 include an induction/TX mode 446 and an induction/RX mode 453. Thus, according to various embodiments, for example, both the first and second hearing aid devices 431 and 432 are capable of detecting the presence of a telephone receiver, receiving an induction signal from the telephone receiver, and presenting a signal representative of the induction signal to the hearing aid receiver. Additionally, both of the first and second hearing aid devices 431 and 432 are capable of wirelessly transmitting a signal representative of the induction signal to and wirelessly receiving a signal 433 representative of the induction signal from the other hearing aid device.

Figure 5:
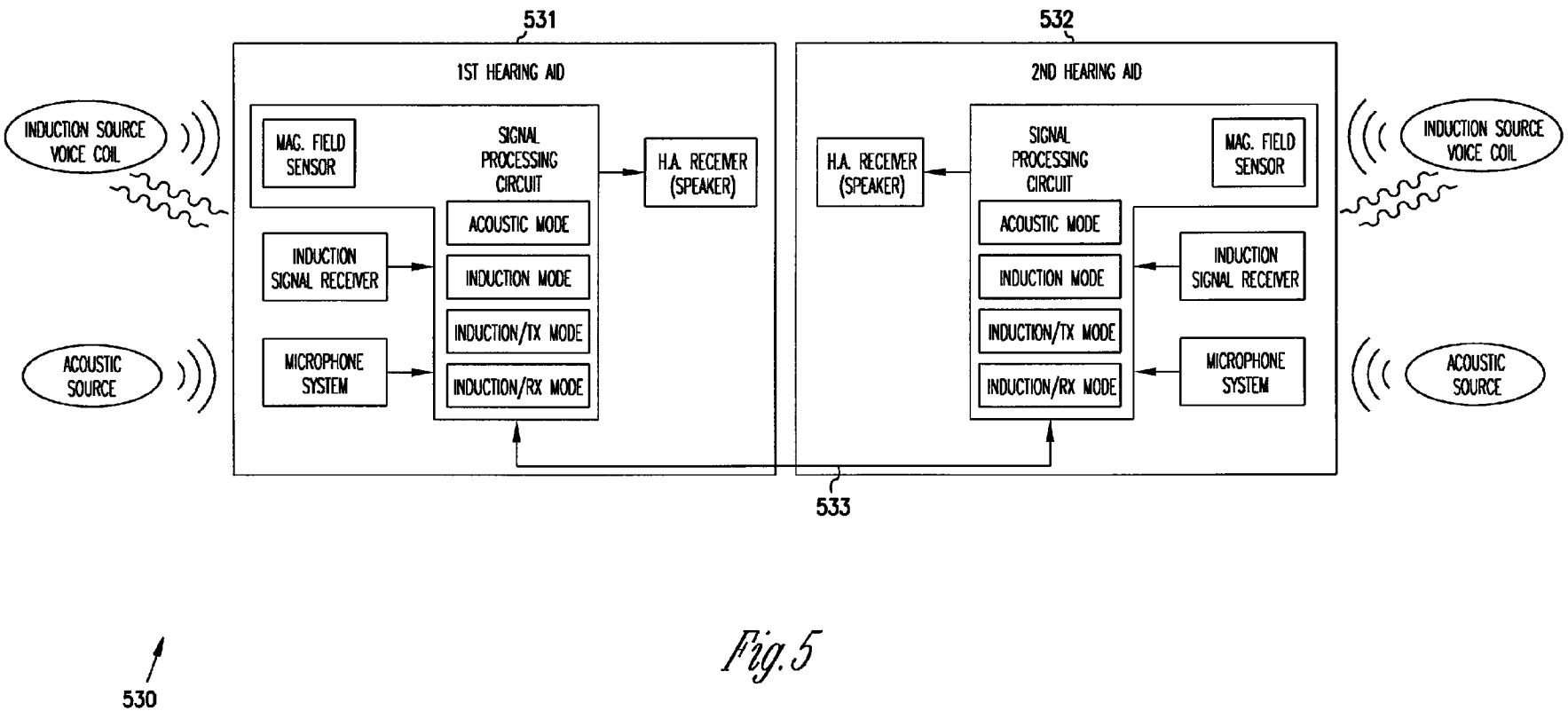
FIG. 5 illustrates a hearing aid system according to various embodiments of the present subject matter.

FIG. 5 illustrates a hearing aid system according to various embodiments of the present subject matter. The hearing aid system 530 of FIG. 5 is generally similar to the hearing aid system 430 of FIG. 4. In the illustrated hearing aid system 530, both of the first and second hearing aid devices 531 and 532 are capable of wirelessly transmitting a signal representative of the induction signal to and wirelessly receiving a signal 533 representative of the induction signal from the other hearing aid device via wired media. In various embodiments, the wire media includes, but is not limited to, conductive media in neckless, glasses, and devices that extend a conductive media between the first and second hearing aids.

Figure 6:
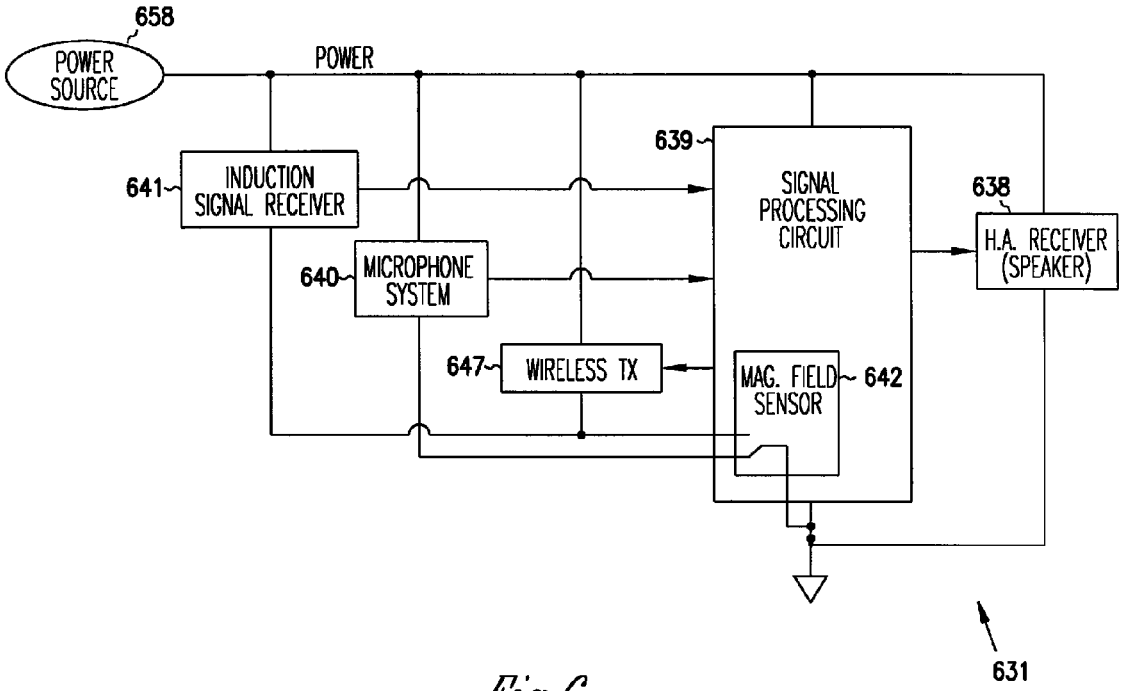
FIG. 6 illustrates a first hearing aid device such as that shown in the system of FIG. 2 according to various embodiments of the present subject matter.

FIG. 6 illustrates a first hearing aid device such as that shown in the system of FIG. 2 according to various embodiments of the present subject matter. The figure illustrates power and communication for various embodiments of the first hearing aid device 631. A first reference voltage (such as that provided by a power source 658) and a second reference voltage (such as that provided by ground) provides power to the induction signal receiver 641, microphone system 640, wireless transmitter 647, signal processing circuit 639 and hearing aid receiver 638. In various embodiments, power is also provided to the sensor 642. In various embodiments, the sensor 642 includes a reed switch or MEMS device capable of being actuated by a magnetic field.

In the illustrated device 631, the sensor 642 provides a ground path, and thus selectively provides power, either to the microphone system 640 or to both the induction signal receiver 641 and the wireless transmitter 647. One of ordinary skill in the art will understand, upon reading and comprehending this disclosure, that various embodiments provide the sensor between the power rail and the components 641, 640 and 647 so as to selectively connect and disconnect power to the components (i.e. to selectively actuate and deactivate the components).

In various embodiments, the magnetic field sensor 642 defaults to provide power to the microphone system and does not provide power to the induction signal receiver 641 and the wireless transmitter 647. Thus, the signal processing circuit 639 receives a signal from the microphone system, and provides a representative signal to the hearing aid receiver 638. According to various embodiments, when the sensor 642 detects a magnetic field gradient from a telephone receiver, the sensor 642 provides power to the induction signal receiver 641 and the wireless transmitter 647, and does not provide power to the microphone system 640. Thus, the signal processing circuit 639 receives a signal from the induction signal receiver 641, provides a representative signal to the hearing aid receiver 638, and wirelessly transmits a representative signal using wireless transmitter 647.

Figure 7:
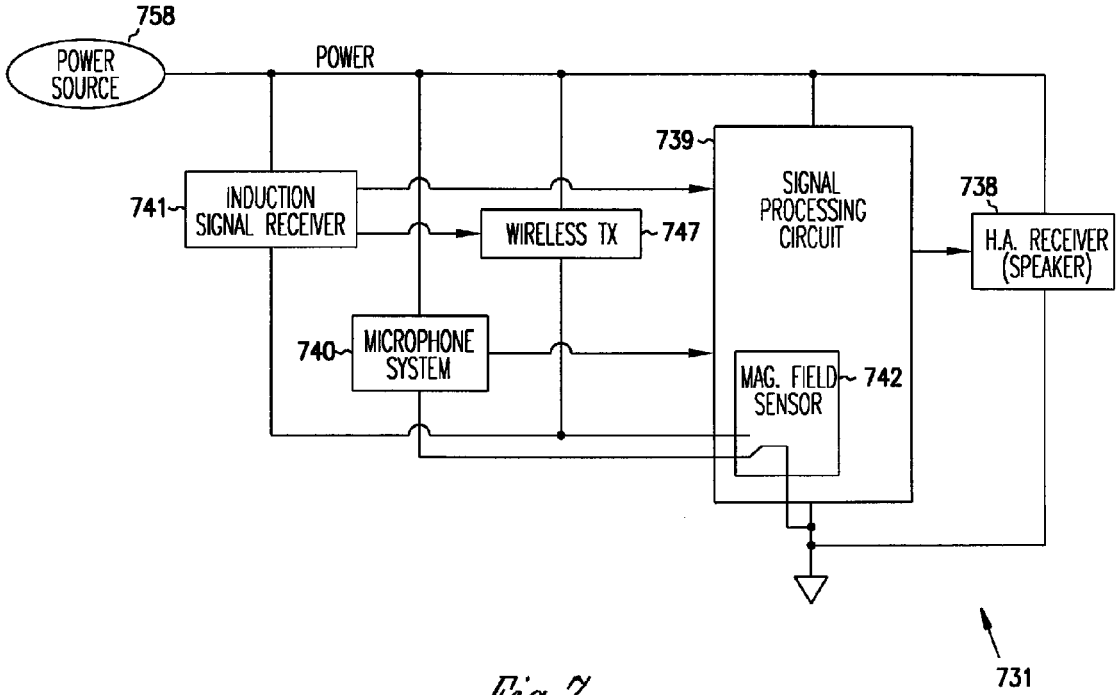
FIG. 7 illustrates a first hearing aid device such as that shown in the system of FIG. 2 according to various embodiments of the present subject matter.

FIG. 7 illustrates a first hearing aid device such as that shown in the system of FIG. 2 according to various embodiments of the present subject matter. The hearing aid device 731 of FIG. 7 is generally similar to the hearing aid device 631 of FIG. 6. In the illustrated hearing aid system 730, the wireless transmitter 747 transmits a signal representative of a signal received directly from the induction signal receiver rather than from the signal processing circuit 739. Thus, the signal processing circuit 739 does not have a separate induction mode and induction/TX mode. Rather, the signal processing circuit 739 either operates in an acoustic mode or in an induction-induction/TX mode.

Figure 8:
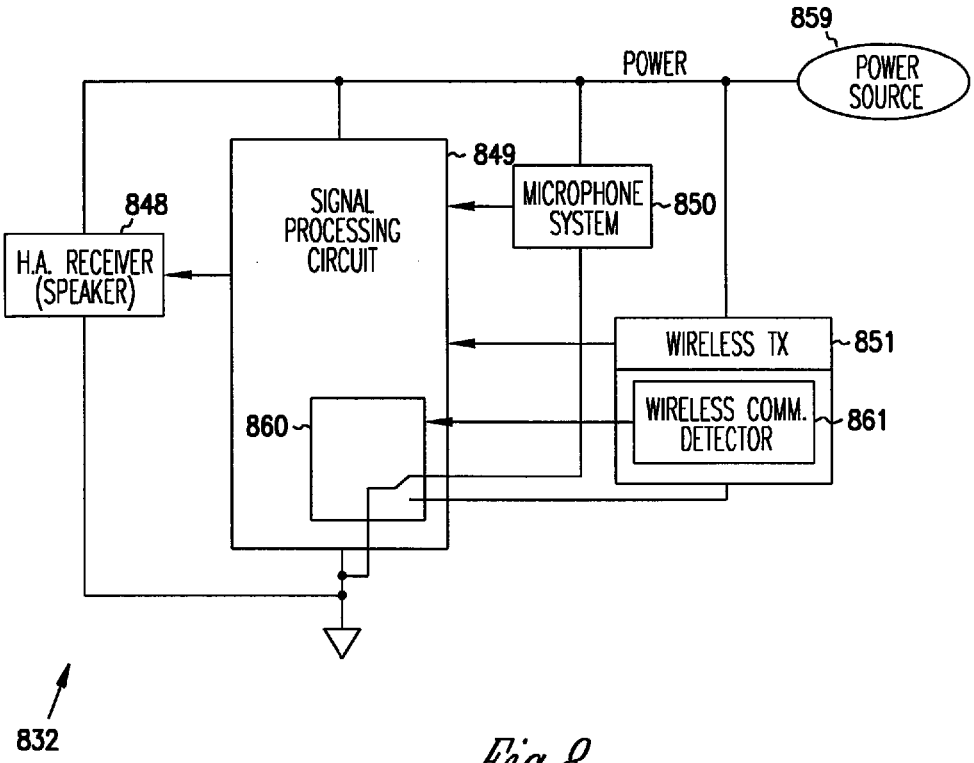
FIG. 8 illustrates a second hearing aid device such as that shown in the system of FIG. 2 according to various embodiments of the present subject matter.

FIG. 8 illustrates a second hearing aid device such as that shown in the system of FIG. 2 according to various embodiments of the present subject matter. The figure illustrates power and communication for various embodiments of the second aid device 832. A first reference voltage (such as that provided by a power source 659) and a second reference voltage (such as that provided by ground) provides power to the microphone system 850, wireless receiver 851, signal processing circuit 849 and hearing aid receiver 848.

In the illustrated device 832, a switch 860 in the signal processing circuit 849 provides a ground path, and thus selectively provides power, either to the microphone system 850 or to the wireless receiver 851. One of ordinary skill in the art will understand, upon reading and comprehending this disclosure, that various embodiments provide the sensor between the power rail and the components 850 and 851 so as to selectively connect and disconnect power to the components. In various embodiments, a wireless communication detector 861 detects a wireless communication from the first hearing aid device (not shown) and provides a control signal to the switch 860. In various embodiments, the wireless communication detector 861 forms part of the wireless receiver 851. In these embodiments, the detector 861 remains active regardless of whether power is generally provided to the receiver 851.

Figure 9:
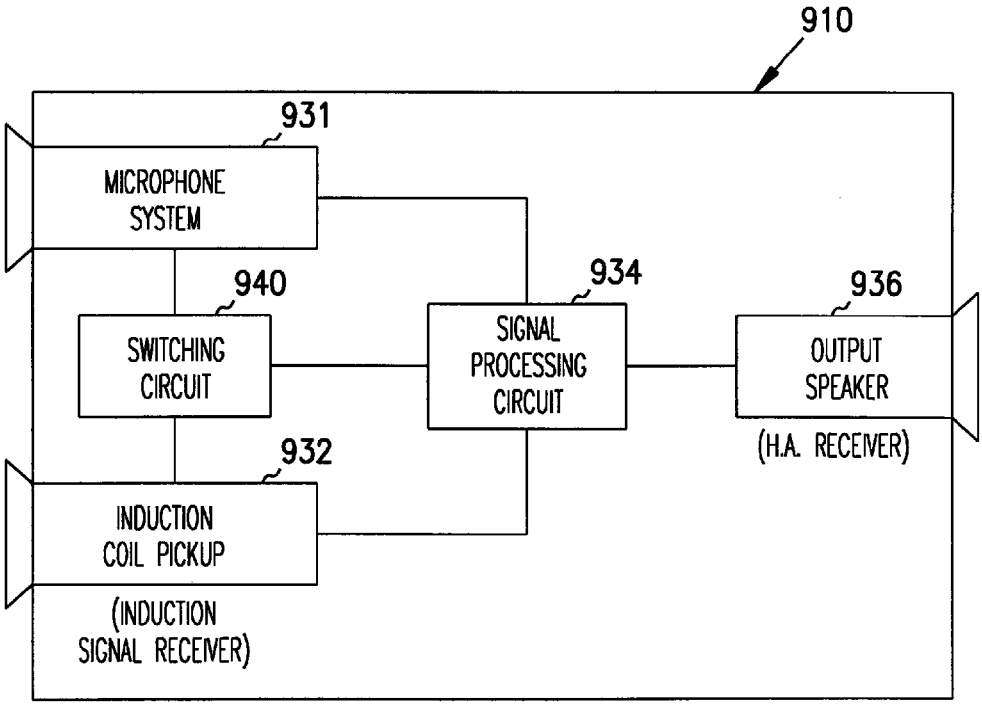
FIG. 9 is a schematic view of a hearing aid device according to various embodiments of the present subject matter.

FIG. 9 is a schematic view of a hearing aid device according to various embodiments of the present subject matter. The illustrated hearing aid 910 has two inputs, a microphone 931 and an induction coil pickup 932. The microphone 931 receives acoustic signals, converts them into electrical signals and transmits same to a signal processing circuit 934. The signal processing circuit 934 provides various signal processing functions which can include noise reduction, amplification, frequency response shaping, and compression. The signal processing circuit 934 outputs an electrical signal to an output speaker 936 which transmits acoustic into the wearer's ear. The induction coil pickup 932 is an electromagnetic transducer, which senses the magnetic field gradient produced by movement of the telephone voice coil 923 and in turn produces a corresponding electrical signal which is transmitted to the signal processing circuit 934. Accordingly, use of the induction coil pickup 932 avoids two of the signal conversions normally necessary when a conventional hearing aid is used with a telephone. These conversions involve the conversion by the telephone handset from a telephone signal to an acoustic signal, and the conversion by the hearing aid microphone 931 from the acoustic signal to an electrical signal. It is believed that the elimination of these signal conversions improves the sound quality that a user will hear from the hearing aid. Advantages associated with receiving the voice signal directly from the telecoil include blocking out environmental noise and eliminating acoustic feedback from the receiver.

A switching circuit 940 is provided to switch the hearing aid input from the microphone 931, the default state, to the induction coil pickup 932, the magnetic field sensing state. It is desired to automatically switch the states of the hearing aid 910 when the telephone handset 914 is adjacent the hearing aid wearer's ear. Thereby, the need for the wearer to manually switch the input state of the hearing aid when answering a telephone call and after the call ends. Finding and changing the state of the switch on a miniaturized hearing aid can be difficult especially when the wearer is under the time constraints of a ringing telephone or if the hearing aid is an in the ear type hearing aid. Additionally, older people tend to lose dexterity, and have great difficulty in feeling the small switch.

Figure 10:
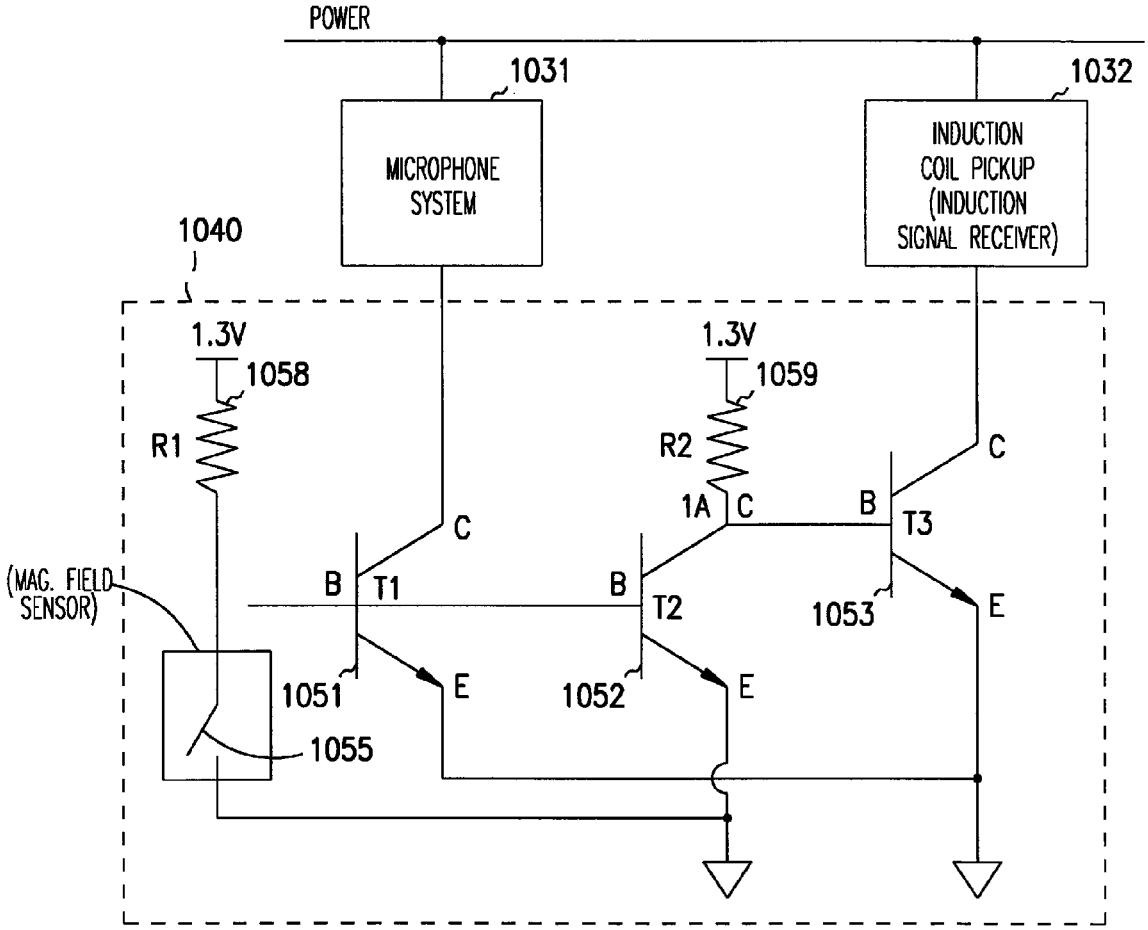
FIG. 10 shows a diagram of the switching circuit of FIG. 9 according to various embodiments of the present subject matter.

FIG. 10 shows a diagram of the switching circuit of FIG. 9 according to various embodiments of the present subject matter. The switching circuit 1040 includes a microphone-activating first switch 1051, here shown as a transistor that has its collector connected to the microphone ground, base connected to a hearing aid voltage source through a resistor 1058, and emitter connected to ground. Thus, the default state of hearing aid 1010 is switch 1051 being on and the microphone circuit being complete. A second switch 1052 is also shown as a transistor that has its collector connected to the hearing aid voltage source through a resistor 1059, base connected to the hearing aid voltage source through resistor 1058, and emitter connected to ground. A voice coil activating third switch 1053 is also shown as a transistor that has its collector connected to the voice pick up ground, base connected to the collector of switch 1052 and though resistor 1059 to the hearing aid voltage source, and emitter connected to ground. A magnetically-activated fourth switch 1055 has one contact connected to the base of first switch 1051 and through resistor 1058 to the hearing aid voltage source, and the other contact is connected to ground. Contacts of switch 1055 are normally open.

In this default, open state of switch 1055, switches 1051 and 1052 are conducting. Therefore, switch 1051 completes the circuit connecting microphone 1031 to the signal processing circuit 1034. Switch 1052 connects resistor 1059 to ground and draws the voltage away from the base of switch 1053 so that switch 1053 is open and not conducting. Accordingly, the hearing aid is operating with microphone 1031 active and the induction coil pickup 1032 inactive. The hearing aid inputs 1031, 1032 are thus mutually exclusive.

Switch 1055 is closed in the presence of a magnetic field, particularly in the presence of the magnetic field produced by telephone handset magnet 1022. In one embodiment of the present subject matter, switch 1055 is a reed switch, for example a microminiature reed switch, type HSR-003 manufactured by Hermetic Switch, Inc. of Chickasha, Okla. Another example of a micro reed switch is MMS-BV50273 manufactured by Meder Electronics of Mashpea, Mass. In a further embodiment of the present subject matter, the switch 1055 is a solid state, wirelessly operable switch. In various embodiments, wirelessly refers to a magnetic signal. Various embodiments of a magnetic signal operable switch is a MAGFET. The MAGFET is non-conducting in a magnetic field that is not strong enough to turn on the device and is conducting in a magnetic field of sufficient strength to turn on the MAGFET. In a further embodiment, switch 1055 is a micro-electro-mechanical system (MEMS) switch. In a further embodiment, the switch 1055 is a magneto resistive device that has a large resistance in the absence of a magnetic field and has a very small resistance in the presence of a magnetic field. When the telephone handset magnet 1022 is close enough to the hearing aid wearer's ear, the magnetic field produced by magnet 1022 changes the state of switch (e.g., closes) switch 1055. Consequently, the base of switch 1051 and the base of switch 1052 are now grounded. Switches 1051 and 1052 stop conducting and microphone ground is no longer grounded. That is, the microphone circuit is open. Now switch 1052 no longer draws the current away from the base of switch 1053 and same is energized by the hearing aid voltage source through resistor 1059. Switch 1053 is now conducting. Switch 1053 connects the voice pickup coil ground to ground and completes the circuit including the induction coil pickup 1032 and signal processing circuit 1034. Accordingly, the switching circuit 1040 activates either the microphone (default) input 1031 or the voice coil (magnetic field selected) input 1032 but not both inputs simultaneously.

In operation, switch 1055 automatically closes and conducts when it is in the presence of the magnetic field produced by telephone handset magnet 1022. This eliminates the need for the hearing aid wearer to find the switch, manually change switch state, and then answer the telephone. The wearer can conveniently, merely pickup the telephone handset and place it by his\her ear whereby hearing aid 10 automatically switches from receiving microphone (acoustic) input to receiving pickup coil (electromagnetic) input. That is, a static electromagnetic field causes the hearing aid to switch from an acoustic input to a time-varying electromagnetic field input. Additionally, hearing aid 1010 automatically switches back to microphone input after the telephone handset 1014 is removed from the ear. This is not only advantageous when the telephone conversation is complete but also when the wearer needs to talk with someone present (microphone input) and then return to talk with the person on the phone (voice coil input).

While the disclosed embodiment references an in-the-ear hearing aid, it will be recognized that the inventive features of the present subject matter are adaptable to other styles of hearing assistance devices, including over-the-ear, behind-the-ear, eye glass mount, implants, body worn aids, noise protection earphones, headphones, etc. Due to the miniaturization of hearing aids, the present subject matter is advantageous to many miniaturized hearing aids. Hearing aids as used herein refer to any device that aids a person's hearings, for example, devices that amplify sound, devices that attenuate sound, and devices that deliver sound to a specific person such as headsets for portable music players or radios.

NPN transistors are generally illustrated as switches in FIG. 10. One of ordinary skill in the art will understand, upon reading and comprehending this disclosure, that the present subject matter is capable of being implemented using, among other devices, bipolar transistors, FET transistors, N-type transistors, P-type transistors and a variety of magnetically-actuated devices and other devices.

Figure 11:
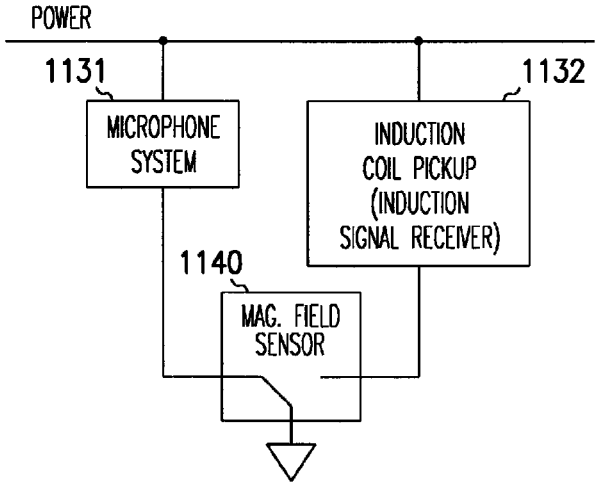
FIG. 11 shows a diagram of the switching circuit of FIG. 9 according to various embodiments of the present subject matter.

FIG. 11 shows a diagram of the switching circuit of FIG. 9 according to various embodiments of the present subject matter. In the illustrated embodiment, the magnetic field sensor 1140 selectively provides power to either the microphone 1131 or to the induction signal receiver (e.g. voice coil power pickup). In various embodiments, sensor 1140 defaults to provide a conductive path to ground for the microphone system 1131 to complete the power circuit to the microphone system 1131, and provides a conductive path to ground for the induction signal receiver 1132 when a telephone handset is operationally proximate to the sensor 1140, for example. In various embodiments, the magnetic field sensor includes the switching circuit 1040 illustrated in FIG. 10.

Figure 12:
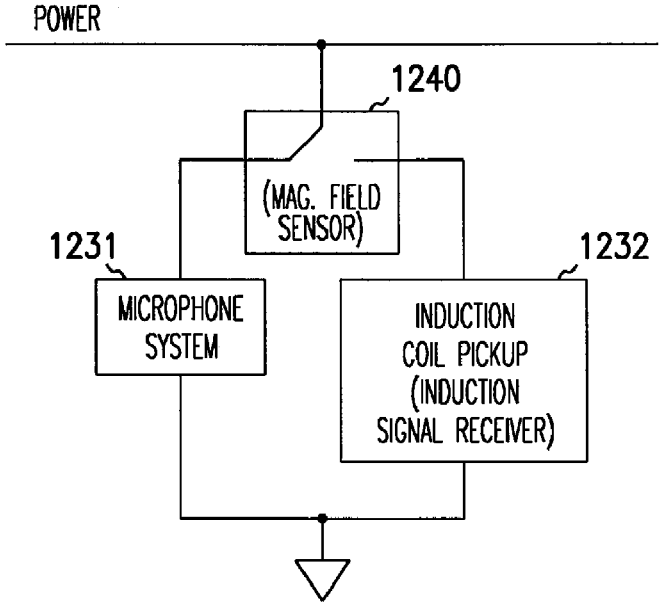
FIG. 12 shows a diagram of the switching circuit of FIG. 9 according to various embodiments of the present subject matter.

FIG. 12 shows a diagram of the switching circuit of FIG. 9 according to various embodiments of the present subject matter. FIG. 12 is generally similar to FIG. 11. In FIG. 12, the sensor 1240 is positioned between the power rail and components 1231 and 1232 to selectively provide a conductive path to provide power to the microphone system 1231 or the induction signal receiver 1232.

Figure 13:
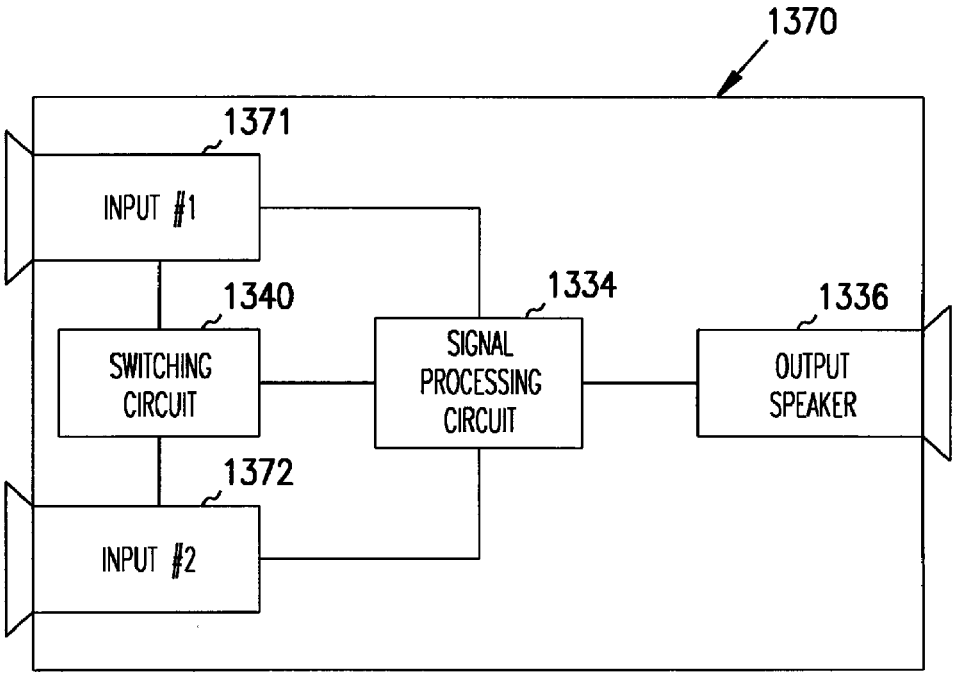
FIG. 13 is a schematic view of a hearing aid according to various embodiments of the present subject matter.

FIG. 13 is a schematic view of a hearing aid according to various embodiments of the present subject matter. The hearing aid 1370 includes a switching circuit 1340, a signal processing circuit 1334 and an output speaker 1336 as described herein. The switching circuit 1340 includes a magnetic field responsive, solid state circuit. The switching circuit 1340 selects between a first input 1371 and a second input 1372.

In various embodiments, the first input 1371 is a microphone system. According to various embodiments, the microphone system includes an omnidirectional microphone system, a directional microphone system or a microphone system capable of switching between an omnidirectional and a direction microphone system. Omnidirectional microphone systems detect acoustical signals in a broad pattern. Directional microphone systems detect acoustical signals in a narrow pattern. In various embodiments, the microphone system (first input) provides a default input to the hearing aid.

In various embodiments, the second input 1372 is an induction signal receiver. When the switching circuit 1340 senses the magnetic field, the hearing aid 1370 switches from its default mode to receive signals from the induction signal receiver (second input 1372). In various embodiments, the activation of the second input 1372 is mutually exclusive of activation of the first input 1371.

In use with a telephone handset, e.g., 114 shown in FIG. 1, hearing aid 1370 changes from its default state with acoustic input 1371 active to a state with induction signal receiving input 1372 active. Thus, hearing aid 1370 receives its input inductively from the telephone handset.

In various embodiment, switching circuit 1340 includes a micro-electromechanical system (MEMS) switch. In various embodiments, the MEMS switch includes a cantilevered arm that in a first position completes an electrical connection and in a second position opens the electrical connection. When used in the circuit as shown in FIG. 10, the MEMS switch is used as switch 1055 and has a normally open position. When in the presence of a magnetic field, the cantilevered arm shorts the power supply to ground according to various embodiments. This initiates a change in the operating state of the hearing aid input.

Figure 14:
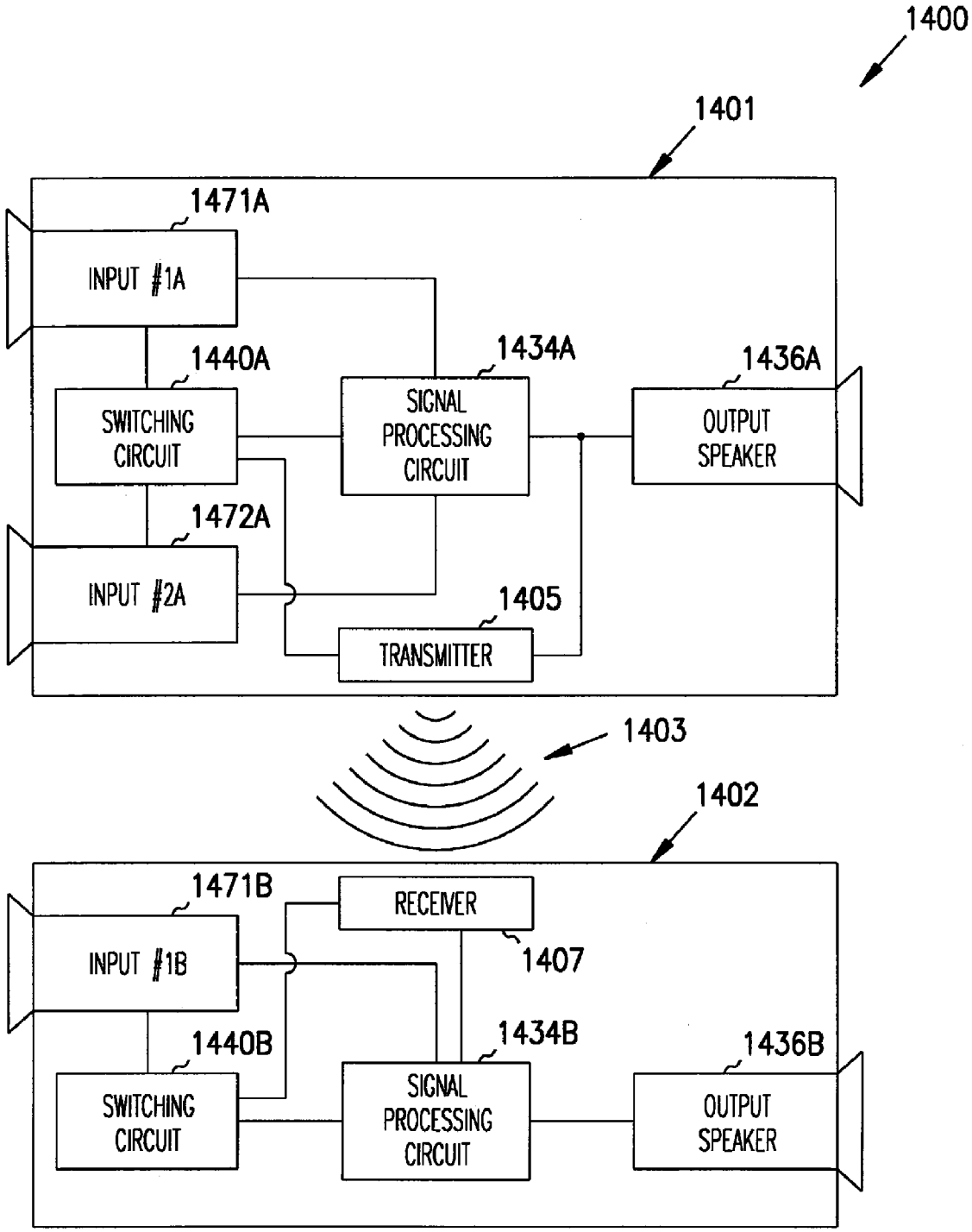
FIG. 14 is a schematic view of a hearing aid system according to various embodiments of the present subject matter.

FIG. 14 is a schematic view of a hearing aid system according to various embodiments of the present subject matter. The hearing aid system 1400 that includes a first hearing aid 1401, a second hearing aid 1402, and a wireless connection 1403 between the two hearing aids 1401, 1402. Elements that are similar in hearing aids 1401, 1402 are respectively designated by the same number but with a suffix "A" for the first hearing aid 1401 and a suffix "B" for the second hearing aid 1402. The first hearing aid 1401 includes a first input 1471A and a second input 1472A. The first input 1471A is an acoustic input, e.g., microphone. In various embodiments, the second input 1472A is an induction input, such as a telecoil. A switching circuit 1440A selects which of the two inputs 1471A, 1472A are electrically connected to the signal processing circuit 1434A. The signal processing circuit 1434A performs any of a number of operations on the signal from one of the inputs 1471A, 1472A and outputs a conditioned signal, which is tuned to the specific hearing assistance needs of the wearer, to the output speaker 1436A.

The second hearing aid 1402 includes a first input 1471B. The first input 1471B is an acoustic input, e.g., microphone. A switching circuit 1440B determines whether input 1471B is electrically connected to the signal processing circuit 1434B. The signal processing circuit 1434B performs any of a number of operations on the signal the input 1471B and outputs a conditioned signal, which is tuned to the specific hearing assistance needs of the wearer, to the output speaker 1436B. The second hearing aid 1402 assists a wearer's hearing in an ear different from the first. Often times, an individual in need of a hearing assistance device has different hearing assistance needs in each ear. Accordingly, the signal processor 1434B of the second hearing aid 1402 conditions a hearing signal differently then the first hearing aid's signal processor 1434A.

Wireless connection 1403 includes a transmitter 1405 connected to the first hearing aid 1401 and a receiver 1407 connected to the second hearing aid 1402. In various embodiments, receiver 1407 includes an amplitude modulated transmitter circuit such as a Ferranti MK-484 solid state AM receiver. In various embodiments, other wireless technology is incorporated. In various embodiments, the receiver 1407 is positioned within the housing (ear mold) of the second hearing aid and is powered by the second hearing aid battery (not shown). Transmitter 1405, in various embodiments, includes a tuned circuit that produces an amplitude modulated signal that is adapted for reception by the receiver 1407. In various embodiments, the transmitter 1405 is positioned within the housing (ear mold) of the first hearing aid and is powered by the first hearing aid battery (not shown). The transmitter 1405 is connected to the first hearing aid switching circuit 1440A and based on the state of switching circuit 1440B, transmitter 1405 sends a signal to the receiver 1407. In various embodiments, the receiver 1407 sends a signal to switching circuit 1440B. In response to this signal, the switching circuit 1440B turns off the first input 1471B. Additionally, in response to this signal, the switching circuit 1440B sends a signal to the signal processing circuit to process a signal received at receiver 1407 that is representative of a signal provided by the second input 1472A of the first hearing aid 1401. Thus, for example, the transmitter 1405 sends a second hearing aid microphone 1471B off signal to the receiver 1407. The second hearing aid microphone 1471B is off while the first hearing aid 1401 is in a state with the second input 1472A being active. Accordingly, the wearer of the hearing aid system 1400 receives a signal only from the second input 1472A of the first hearing aid 1401 in the first ear. No input into the second ear is received from the first input (microphone) 1471B of the second hearing aid 1402.

The transmitter 1405 sends the second state signal of the first hearing aid 1401 to the second hearing aid 1402. The second hearing aid 1402 turns off input 1471B based on the signal received by receiver 1407. In various embodiments, the transmitter 1405 receives a processed signal from the signal processing circuit 1434A and sends the processed signal to the receiver 1407. In various embodiments, the transmitter 1405 receives the input signal from the second input 1472A and sends this signal to the receiver 1407. The receiver 1407 provides the received signal to the signal processor of 1434B of the second hearing aid 1402. The signal processor 1434B processes the signal to the hearing assistance needs of the second ear and sends a conditioned signal to output speaker 1436B. Accordingly, the wearer of the hearing aid system 1400 receives conditioned signals based on inductive signals sensed by the second input 1472A of the first hearing aid 1401 from both the first hearing aid 1401 and the second hearing aid 1402. That is, the input, for example, telecoil input from a telephone, into one hearing aid is provided to the hearing aid wearer in both ears. Such a diotic signal utilizes both signal processing abilities of both hearing aids 1401, 1402 to provide a signal to the wearer that improves performance. When the second hearing aid 1402 is an in-the-ear or behind-the-ear hearing aid, the body (ear mold) of the second hearing aid passively attenuates ambient noise. It is noted that the present subject matter is not limited to a particular hearing aid type, as it can be incorporated with in-the ear hearing aids, behind-the-ear hearing aids, in-the-canal hearing aids, completely in the canal (CIC) hearing aids, and other hearing aid devices. Moreover, the first and second hearing aids 1401, 1402 both providing a diotic signal (which is conditioned for a respective ear) to the wearer. The diotic signal allows both hearing aids to use less gain due to central fusion summing of the signal.

Figure 15:
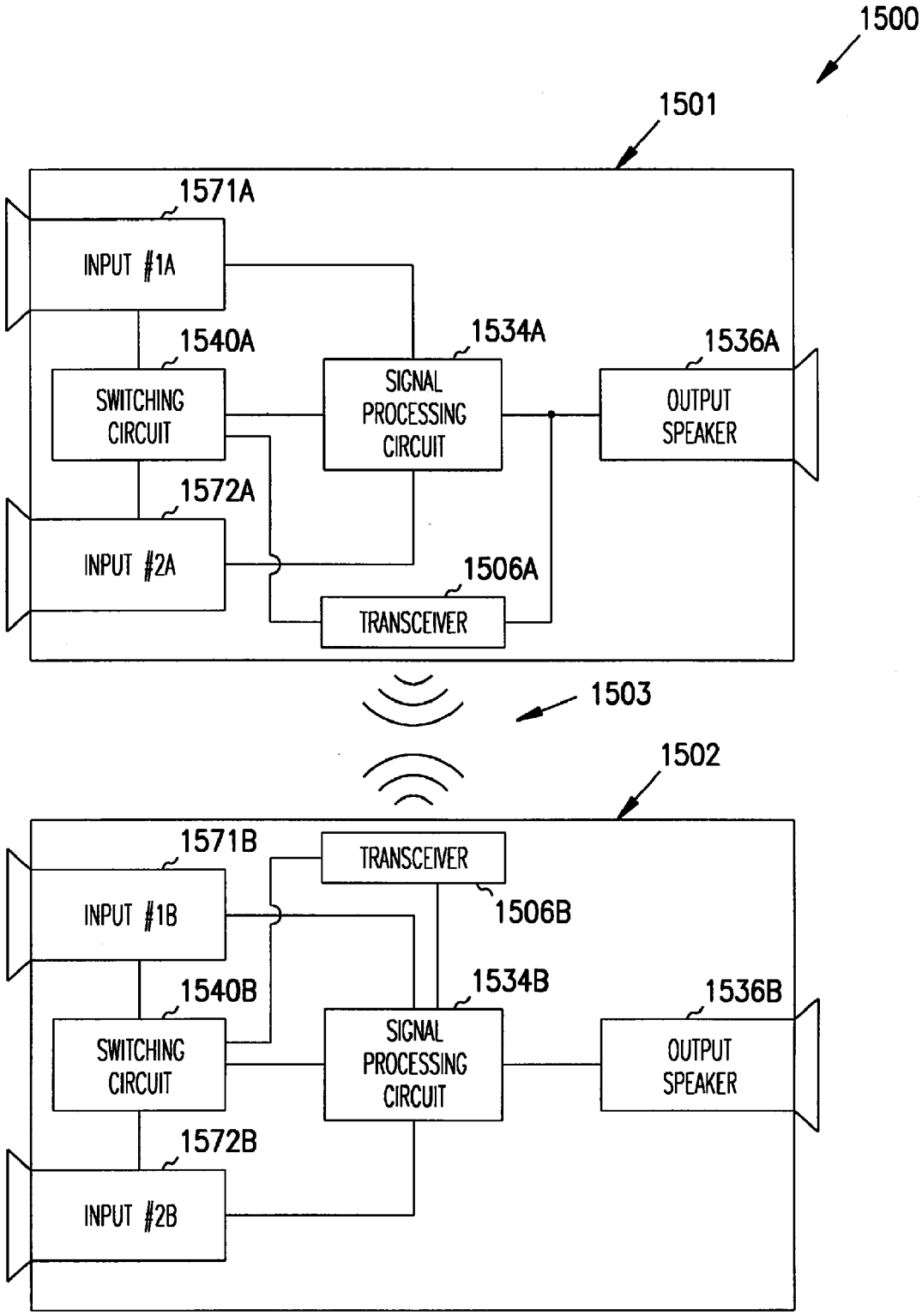
FIG. 15 is a schematic view of a hearing aid system according to various embodiments of the present subject matter.

FIG. 15 is a schematic view of a hearing aid system according to various embodiments of the present subject matter. The hearing aid system 1500 that includes a first hearing aid 1501, a second hearing aid 1502, and a wireless connection 1503 between the two hearing aids 1501, 1502. Like elements in both the first and second hearing aids 1501 and 1502 differentiated by the suffixes "A" and "B", respectively.

The first hearing aid 1501 includes a first transceiver 1506A that is connected to the switching circuit 1540A and the signal processing circuit 1534A. The transceiver 1506A receives a state signal from the switching circuit 1540A. The state signal represents which of the two inputs 1571A, 1572A is currently actively sensing an input signal. In various embodiments, the first input is the default state of the hearing aid 1501. The first input 1571A includes a microphone that senses and transduces an acoustic signal into an electrical signal. In various embodiments, the second input 1572A includes an induction sensor, e.g., a telecoil. The second input 1571A senses a magnetic field and transduces the magnetic signal into an electrical signal.

The second hearing aid 1502 includes a second transceiver 1506B that is connected to the switching circuit 1540B and the signal processing circuit 1534B. The second transceiver 1506B receives a state signal from the switching circuit 1540B. The state signal represents which of the two inputs 1571B, 1572B is currently actively sensing an input signal and sending an electrical signal to the signal processing circuit 1534B. In various embodiments, the first input is the default state of the second hearing aid 1502. The first input 1571B includes a microphone that senses and transduces an acoustic signal into an electrical signal. In various embodiments, the second input 1572B of the second hearing aid 1506B includes an induction sensor, e.g., a telecoil. The second input 1572B senses a magnetic field and transduces the magnetic signal into an electrical signal.

The default state of the system 1500 includes both the first inputs 1571A and 1571B sending signals to the respective signal processing circuits 1534A and 1534B. Thus, the wearer of the hearing aid system 1500 receives a binaural signal representative of the acoustics of the surrounding environment.

Wireless connection 1503 links the first and second hearing aids 1501, 1502 through transceivers 1506A, 1506B. The first transceiver 1506A and the second transceiver 1506B stand ready to receive a signal from the other transceiver with both the first and second hearing aids operating in the default mode. The default mode for both hearing aids 1501, 1502 includes the first inputs 1571A and 1571B being active and acoustically sensing a signal. The hearing aids 1501, 1502 respectively condition signals sensed by inputs 1571A, 1571B, respectively for output to the respective ears of the wearer. When the switching circuit 1540A changes the mode of the hearing aid 1501 from the first input 1571A to the second input 1572A, the first transceiver 1506A sends a signal to the second transceiver 1506B. The second transceiver 1506B causes the second switching circuit 1540B to turn off the first input 1571B and the second input 1572B (the second hearing aid signal is provided by the second input 1571A of the second hearing aid 1501 and is received by the signal processing circuit 1534B). Thus, the first input 1571B and the second input 1572B are turned off when the first hearing aid 1501 is in its second input mode with its second input 1572A sensing an input signal and providing same to the signal processing circuit 1534A.

In various embodiments, the transceivers communicate a processed signal from one of the signal processing circuits to the other; and in various embodiments, the transceivers communicate an unprocessed signal from one of the signal processing circuits to the other transceiver. For example, in various embodiments, the first transceiver 1506A receives the second state, input signal from the second input 1572A. The first transceiver 1506A sends this input signal to the second transceiver 1506B. Thus, the second hearing aid 1502 receives the unprocessed output signal from the second input 1572A of the first hearing aid 1501. The second transceiver 1506B sends the received signal to the signal processing circuit 1534B. Signal processing circuit 1534B processes the signal and sends a further processed signal, which is processed to produce an output signal that matches the hearing assistance needs of the second ear, to the output speaker 1536B. Accordingly, both the first and second hearing aids 1501, 1502 respectively output to the first and second ears a signal based on the input sensed by the second input 1572A of the first hearing aid 1501. In one use, the second input 1572A includes a telecoil that senses the time-varying component of a telephone handset. As a result, the hearing aid system wearer receives the telephone input in both ears by wirelessly linking the first hearing aid to the second hearing aid.

The second transceiver 1506B receives a state signal from the switch 1540B and sends this signal to the first transceiver 1506A in the second input mode of the second hearing aid 1502. The first transceiver 1506A provides this signal to the switching circuit 1540A, which turns off the first input 1571A and the second input 1572A. Thus, the first input 1571A and the second input 1572A are off when the second input 1571B of the second hearing aid 1502 is active (the first hearing aid signal is provided by the second input 1571B of the second hearing aid 1502 and is received by the signal processing circuit 1534A). In various embodiments, the second transceiver 1506B receives the second state, input signal from the second input 1572B. The second transceiver 1506B sends this input signal to the first transceiver 1506A. Thus, the first hearing aid 1501 receives the unprocessed output signal from the second input 1572B of the second hearing aid 1502. The first transceiver 1506A sends the received signal to the signal processing circuit 1534A of the first hearing aid 1501. Signal processing circuit 1534A processes the signal and sends a further processed signal, which is processed to produce an output signal that matches the hearing assistance needs of the first ear, to the output speaker 1536A. Accordingly, both the first and second hearing aids 1501, 1502 respectively output to the first and second ears a signal based on the input sensed by the second input 1572B of the second hearing aid 1502. In one use, the second input 1572B includes a telecoil that senses the time-varying component of a telephone handset. As a result, the hearing aid system wearer receives the telephone input in both ears by wirelessly linking the first hearing aid 1501 to the second hearing aid 1502. Further, the hearing aid system wearer is not limited to inductive input to only one hearing aid. The wearer uses either hearing aid to provide inductive input to both hearing aids and thus, both ears. In various embodiments, the transceivers communicate a processed signal from one of the signal processing circuits to the other; and in various embodiments, the transceivers communicate an unprocessed signal from one of the signal processing circuits to the other transceiver. For example, in various embodiments, the second transceiver 1506B receives the signal from the signal processing circuit 1534B and sends this signal to the first transceiver 1506A in the second input mode of the second hearing aid 1502. Thus, the first hearing aid 1501 receives the unprocessed output signal from the second hearing aid 1502. The first transceiver 1506A sends the received signal to the signal processing circuit 1534A of the first hearing aid 1501. Signal processing circuit 1534A processes the signal and sends a further processed signal, which is processed to produce an output signal that matches the hearing assistance needs of the first ear, to the output speaker 1536A of the first hearing aid. Accordingly, both the first and second hearing aids 1501, 1502 respectively output to the first and second ears a signal based on the input sensed by the second input 1572B of the second hearing aid 1502. In one use, the second input 1572B includes a telecoil that senses the time-varying component of a telephone handset. As a result, the hearing aid system wearer receives the telephone input in both ears by wirelessly linking the first hearing aid 1501 to the second hearing aid 1502.

Figure 16:
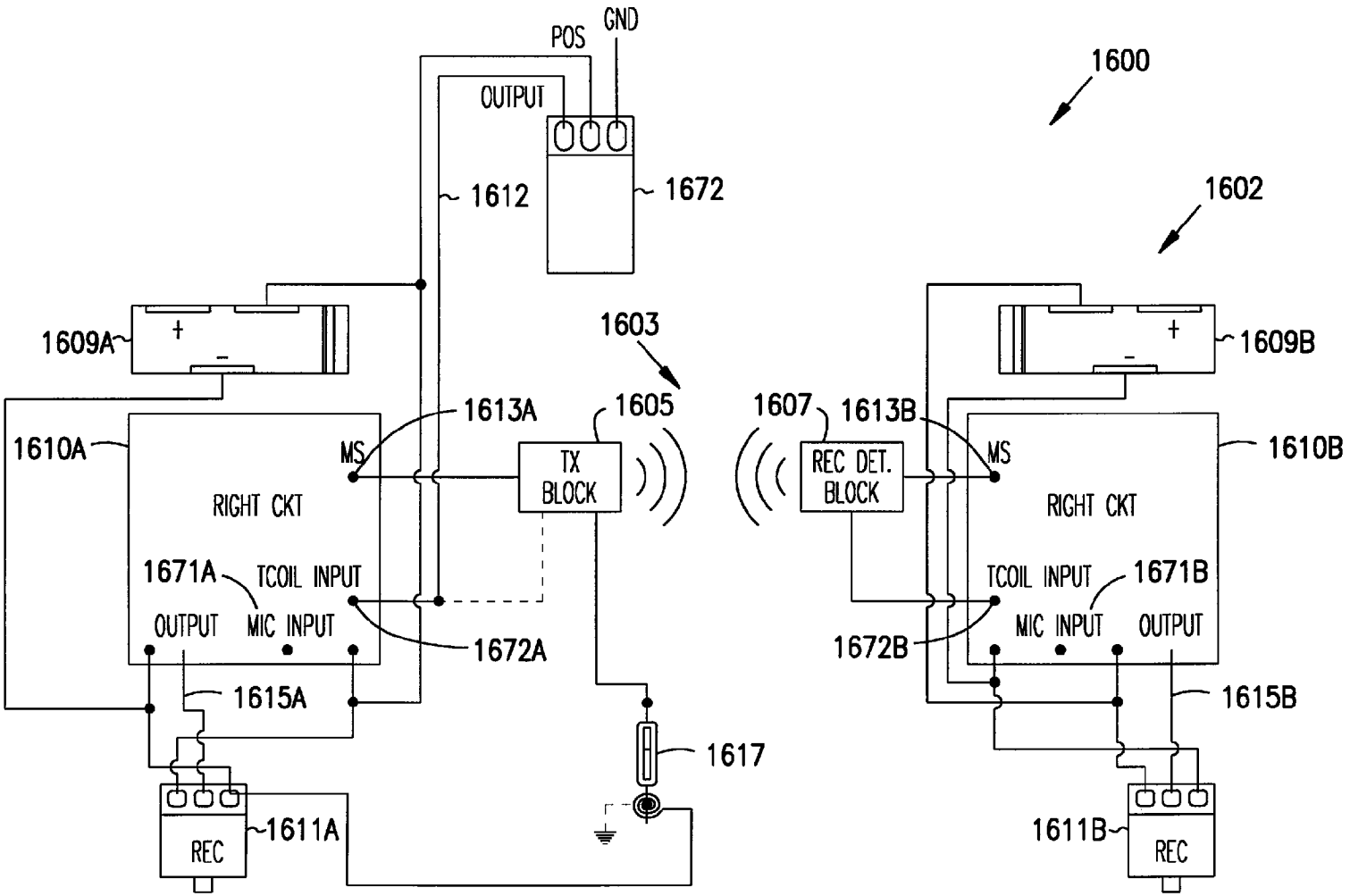
FIG. 16 is a schematic view of a hearing aid system according to various embodiments of the present subject matter.

FIG. 16 is a schematic view of a hearing aid system according to various embodiments of the present subject matter. The hearing aid system 1600 includes a first hearing aid 1601, a second hearing aid 1602, and a wireless link 1603 connecting the first and second hearing aids. The first hearing aid 1601 includes a power source 1609A powering a telecoil 1672A, a first input system circuit 1610A and a hearing aid receiver 1611A. Receiver 1611A receives an output signal 1615A from the first input system circuit 1610A and conditions the signal according to the hearing aid wearer's assistance needs in a first ear. Power source 1609A includes at least one of the following a battery, a rechargeable battery and/or a capacitor. In various embodiments, the telecoil 1672A is a passive telecoil, and thus, is not connected to power source 1609A. The telecoil 1672A is adapted to sense a time-varying component of an electromagnetic field and produce an output signal 1612 that is received by a telecoil input of input system circuit 1610A. The input system circuit 1610A includes a plurality of inputs and switching circuits that select which of the inputs provides the output signal 1615 to receiver 1611A. In various embodiments, the inputs includes a microphone input 1671A and telecoil input 1672A. In various embodiments, the switching circuit includes the switching circuit 40 described herein. In various embodiments, the switching circuit includes a magnetic field responsive, solid state switch. The input system circuit 1610A includes a switch 1613A that selectively connects a transmitter 1605 of the wireless connection 1603 to the power source 1609A. The switch 1613A, in various embodiments, is a manual switch that allows the hearing aid wearer to manually turn off the transmitter 1605 and, hence the wireless connection 1603. In various embodiments, switch 1613A is a master selection switch that connects one of the microphone input 1671A and the telecoil input 1672A to the receiver 1611A. In various embodiments, switch 1613A further selectively connects the telecoil input 1672A to the transmitter circuit block 1605.

Wireless connection 1603 includes transmitter circuit block 1605 that is adapted to send a wireless signal to receiver 1607. Transmitter circuit block 1605 is connected to the receiver 1611A through a magnetical field operable switch 1617. Switch 1617 completes the electrical circuit and causes the transmitter circuit block 1605 to transmit a signal when the switch is closed. The normal, default state of the switch 1617 is open. The switch 1617 closes when it senses a magnetic field of sufficient strength to close the switch and/or cause the switch to conduct. Switch 1617, in various embodiments, is a mechanical switch. In various embodiments, mechanical switch 1617 is a reed switch. In various embodiments, switch 1617 is a solid state switch. In various embodiments, solid state switch 1617 is a MAGFET. In various embodiments, the solid state switch 1617 is a giant magneto resistive switch. In various embodiments, the solid state switch 1617 is a anisotropic resistive switch. In various embodiments, the solid state switch 1617 is a spin dependent tunneling switch. The switch 1617 is set to conduct when the switch 1613A switches the input circuit 1610A to telecoil input 1672A. In various embodiments, the transmitter circuit block 1605 connects one of the telecoil input 1672A or the input to the receiver 1611A to the transmitter circuit block 1605. The electrical connections for the embodiment with the transmitter circuit block 1605 connected directly to the telecoil input are shown in broken line in FIG. 16. The electrical connections for the embodiment with the transmitter circuit block 1605 connected to the receiver 1611A are shown in solid line in FIG. 16. Accordingly, when in the presence of a magnetic field that switches input from microphone input 1671A to telecoil input 1672A, switch 1617 activates the transmitter circuit block 1605 to send the sensed, telecoil signal to the receiver 1607.

Second hearing aid 1602 includes elements that are substantially similar to elements in first hearing aid 1601. These elements are designated by the same numbers with the suffix changed to "B". Receiver 1607 is adapted to receive a signal from transmitter circuit block 1605. A master switch 1613B connects the receiver to the second input circuit 1610B. Master switch 1613B, in various embodiments, is a manual switch that allows the hearing aid wearer to turn of the receiver block 1607 and, hence, the wireless connection 1603. The receiver 1607 is also connected to the telecoil input 1672B of the second hearing aid 1602. In various embodiments, the master switch 1613 is a switch that selects the active input, either the microphone input 1671B or the telecoil input 1672B. In operation, when the receiver 1607 detects a signal from transmitter 1605, the master switch 1613B switches from its default state with the microphone input 1671B selected to the telecoil input 1672B selected (telecoil input state). The telecoil input 1672B is not hard wired to a telecoil. The telecoil input 1672B receives an input signal from receiver 1607. This input signal is from the telecoil input 1672A connected to the other hearing aid 1601 and is wirelessly broadcast by the transmitter circuit block 1605 to receiver 1607. Accordingly, the hearing aid system wearer receives a diotic signal from both hearing aids based on a single input received by a single hearing aid.

While the above described embodiments refer to a wireless link between the hearing aids, it will be recognized that the hearing aids could be hard wired together. However, consumers tend to prefer cosmetically attractive hearing aids, which are generally defined as smaller, less visible hearing aids.

The above description further uses an output speaker as the means to transmit an output signal to a hearing aid wearer. It will be recognized that other embodiments of the present subject matter include bone conductors and direct signal interfaces that provide the output signal to the hearing aid wearer.

As has been provided above, the present subject matter provides improved systems, devices and methods for selectively coupling hearing aids to electromagnetic fields. In various embodiments, a first hearing aid device is capable of operating in an acoustic mode to receive and process acoustic or acoustic signals, an electromagnetic mode to receive and process electromagnetic signals from a telephone coil when the telephone coil is proximate to the first hearing aid device, and an induction/transmitter mode to transmit a signal indicative of the received electromagnetic signals to a second hearing aid device. The second hearing aid device is capable of operating in an acoustic mode to receive and process acoustic or acoustic signals, and an induction/receiver mode to receive and process the signal transmitted from the first hearing aid device when a telephone coil is proximate to the first hearing aid device.

According to various embodiments, when a wearer places a telephone handset proximate to a hearing aid device, the hearing aid device is switched automatically into induction mode with a magnetic sensor (such as a reed switch or MEMS equivalent, for example), and the desired telephone signal is presented diotically to the two ears of the hearing aid wearer. The present subject matter improves listening over the telephone due to the amplification of the telephone signal in the remote ear and the passive attenuation of ambient sounds by the ear mold in that ear. According to various embodiments, less gain is required from each hearing aid due to central fusion summing the signals at the two ears.

One of ordinary skill in the art will understand, upon reading and comprehending this disclosure, that the present subject matter is capable of being incorporated in a variety of hearing aids. For example, the present subject mater is capable of being used in custom hearing aids such as in-the-ear, half-shell and in-the-canal styles of hearing aids, as well as for behind-the-ear hearing aids. Furthermore, one of ordinary skill in the art will understand, upon reading and comprehending this disclosure, the method aspects of the present subject matter using the figures presented and described in detail above.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. A hearing device for automatically receiving induction signals from a voice coil of a telephone handset, comprising:

a hearing aid receiver;

a microphone system for receiving acoustic signals;

means for presenting a first signal representative of the acoustic signals to the hearing aid receiver;

means for detecting the voice coil of the telephone handset;

an induction signal receiver for receiving the induction signals from the voice coil of the telephone handset;

means for presenting a second signal representative of the induction signals to the hearing aid receiver when the voice coil is detected; and means for communicating a third signal representative of the induction signals to a second hearing aid device when the voice coil is detected.

2. The device of claim 1, further comprising:

means for receiving a fourth signal communicated from the second hearing aid device, the fourth signal being representative of the induction signals from the voice coil of the telephone handset; and means for presenting a fifth signal representative of the fourth signal to the hearing aid device.

3. The device of claim 1, wherein the means for communicating a third signal includes means for wirelessly communicating the third signal.

4. The device of claim 3, wherein the means for wirelessly communicating the third signal include RF communication means.

5. The device of claim 1, wherein the means for communicating a third signal representative of the induction signals to a second hearing aid device when the voice coil is detected includes means for transmitting the third signal through a conductor to the second hearing aid device.

6. The device of claim 1, wherein the means for presenting a first signal representative of the acoustic signals to the hearing aid receiver is inactive when the means for presenting a second signal representative of the induction signals to the hearing aid receiver is active.

7. The device of claim 1, wherein the means for detecting the voice coil of the telephone handset includes a magnetic field sensor.

8. A hearing aid device for selectively coupling to induction signals produced by an induction source, comprising:

an induction signal receiver for receiving induction signals;

a microphone system for receiving acoustic signals;

a hearing aid receiver;

a signal processing circuit operably connected to the induction signal receiver, the microphone system, and the hearing aid receiver, the signal processing circuit including a proximity sensor for detecting the induction source, wherein the signal processing circuit is adapted to present a first signal that is representative of the acoustic signals to the hearing aid receiver, and a second signal to the hearing aid receiver that is representative of the induction signals when the induction source is detected, and a wireless transmitter to wirelessly transmit a third signal representative of the induction signals for reception by a second hearing aid device when the induction source is detected.

9. The device of claim 8, further comprising a wireless receiver connected to the signal processing circuit to receive a fourth signal wirelessly transmitted by the second hearing aid device, the fourth signal being representative of the induction signals.

10. The device of claim 8, wherein the proximity sensor includes a magnetic field sensor for sensing a magnetic field gradient from a telephone handset.

11. The device of claim 10, wherein the magnetic field sensor includes a reed switch.

12. The device of claim 10, wherein the magnetic field sensor includes a micro-electro-mechanical system (MEMS) switch.

13. The device of claim 10, wherein the magnetic field sensor includes a magnetic sensing transducer.

14. The device of claim 10, wherein the magnetic field sensor includes a solid state switch.

15. The device of claim 14, wherein the solid state switch includes a MAGFET.

16. The device of claim 14, wherein the solid state switch includes a giant magneto resistive switch.

17. The device of claim 14, wherein the solid state switch includes an anisotropic resistive switch.

18. The device of claim 14, wherein the solid state switch includes a spin dependent tunneling switch.

19. The device of claim 14, wherein the solid state switch includes a Hall-effect switch.

20. The device of claim 10, wherein the magnetic field sensor is adapted to selectively provide power to the microphone system and the induction signal receiver.

21. The device of claim 20, wherein the magnetic field sensor is adapted to selectively provide power to the wireless transmitter.

22. The device of claim 8, wherein the induction signal receiver includes an induction coil pickup for coupling with the induction fields produced by a telephone handset.

23. The device of claim 8, wherein the proximity sensor is adapted to deactivate the microphone system and activate the induction signal receiver when the induction source is detected.

24. The device of claim 8, wherein the microphone system includes a microphone system.

25. The device of claim 24, wherein the microphone system includes an omnidirectional microphone system.

26. The device of claim 24, wherein the microphone system includes a directional microphone system.

27. The device of claim 24, wherein the microphone system is capable of operating in an omnidirectional mode of operation and a directional mode of operation.

28. A hearing aid device for selectively coupling to induction signals produced by an induction source, comprising:

an induction signal receiver for receiving the induction signals;

a microphone system for receiving acoustic signals;

a hearing aid receiver;

a signal processing circuit operably connected to the induction signal receiver, the microphone system, and the hearing aid receiver, wherein the signal processing circuit has an acoustic operational state to present a first signal to the hearing aid receiver that is representative of the acoustic signals, and an induction operational state to present a second signal to the hearing aid receiver that is representative of the induction signals; and a wireless transmitter for wirelessly transmitting a third signal representative of the induction signals for reception by a second hearing aid device.

29. The device of claim 28, wherein the signal processing circuit includes a proximity sensor for detecting the induction source, the signal processing circuit is normally in the acoustic operational state, and the signal processing circuit enters the induction operational state when the induction source is detected.

30. The device of claim 28, wherein the hearing aid device forms a first hearing aid device in a system that includes a second hearing aid device, wherein the second hearing aid device includes:

a microphone system for receiving acoustic signals;

a hearing aid receiver; and a signal processing circuit operably connected to the microphone system and the hearing aid receiver, wherein the signal processing circuit has an acoustic operational state to present a fourth signal to the hearing aid receiver that is representative of the acoustic signals, and an induction operational state to receive the transmitted third signal from the first hearing aid device representative of the induction signals, and to present a fifth signal to the hearing aid receiver that is representative of the induction signals.

31. The device of claim 28, wherein the wireless transmitter includes an RF transmitter.

32. The device of claim 28, wherein the wireless transmitter includes a tuned circuit to transmit an inductively-transmitted signal.

33. The device of claim 28, further comprising a wireless receiver connected to the signal processing circuit to receive a fourth signal wirelessly transmitted by the second hearing aid device, the fourth signal being representative of the induction signals, wherein a fifth signal that is representative of the fourth signal is presented to the hearing aid receiver.

34. A hearing aid device system for selectively coupling to induction signals produced by an induction source, comprising:

a first hearing aid device, including:

a first induction signal receiver for receiving induction signals;

a first microphone system for receiving acoustic signals;

a first hearing aid receiver; and a first signal processing circuit operably connected to the induction signal receiver, the first microphone system, and the first hearing aid receiver, the first signal processing circuit including a first proximity sensor for detecting the induction source, wherein the first signal processing circuit is adapted to transmit a transmitted signal representative of the induction signals from the first hearing aid device when the induction source is detected; and a second hearing aid device, including:

a second microphone system for receiving acoustic signals;

a second hearing aid receiver; and a second signal processing circuit operably connected to the second microphone system and the second hearing aid receiver, wherein the second signal processing circuit is adapted to receive the transmitted signal, wherein the first hearing aid device and the second hearing aid device are adapted to selectively couple with the induction signals produced by the induction source and diotically present a hearing aid signal representative of the induction signals to the first hearing aid receiver and the second hearing aid receiver.

35. The system of claim 34, wherein the first signal processing circuit is adapted to transmit the transmitted signal to the second signal processing circuit through a conductor.

36. The system of claim 34, wherein the first hearing aid device includes a wireless transmitter for wirelessly transmitting the transmitted signal representative of the induction signals to the second hearing aid device, and the second hearing aid device includes a wireless receiver for receiving the transmitted signal.

37. The system of claim 36, wherein the wireless transmitter includes an RF transmitter and the wireless receiver includes an RF receiver.

38. The system of claim 36, wherein the wireless transmitter includes a tuned circuit to transmit an inductively transmitted signal, and the wireless receiver includes an amplitude modulated receiver to receive the inductively transmitted signal.

39. The system of claim 34, wherein:

the second hearing aid device includes a second induction signal receiver for receiving induction signals operably connected to the second signal processing circuit, the second signal processing circuit includes a second proximity sensor for detecting the induction source and is adapted to transmit a transmitted signal representative of the induction signals from the second hearing aid device when the induction source is detected, and both the first hearing aid device and the second hearing aid device include a wireless transceiver for wirelessly transmitting and receiving the transmitted signal representative of the induction signals.

40. The system of claim 39, wherein the wireless transceiver includes an RF transceiver.

41. The system of claim 39, wherein the wireless transceiver includes a tuned circuit to transmit an inductively transmitted signal, and an amplitude modulated receiver to receive the inductively transmitted signal.

42. A method for receiving induction signals produced by an induction source in a first hearing aid device for use in assisting hearing in a first ear and in a second hearing aid device for use in assisting hearing in a second ear, comprising:

converting acoustic signals into a first signal representative of the acoustic signals, and presenting the first signal to a first hearing aid receiver in a first hearing aid device; and upon detecting the induction field source, converting the induction signals from the induction source into a second signal representative of the induction signals, presenting the second signal to the first hearing aid receiver in the first hearing aid device, and transmitting a third signal representative of the induction signals to a second hearing aid device.

43. The method of claim 42, further comprising receiving the third signal representative of the induction signals, and presenting the third signal to a hearing aid receiver in the second hearing aid device.

44. The method of claim 42, wherein the second signal and the third signal are used to diotically present acoustic to a wearer.

45. The method of claim 42, wherein detecting an induction field source includes detecting a magnet in a telephone handset.

46. The method of claim 42, wherein transmitting a third signal representative of the induction signals to a second hearing aid device includes transmitting the third signal to the second hearing aid device through a conductor.

47. The method of claim 42, wherein transmitting a third signal representative of the induction signals to a second hearing aid device includes wirelessly transmitting the third signal to the second hearing aid device.

48. The method of claim 47, wherein wirelessly transmitting the third signal to the second hearing aid device includes transmitting an RF signal to the second hearing aid device.

49. The method of claim 47, wherein wirelessly transmitting the third signal to the second hearing aid device includes transmitting an inductive signal from a tuned circuit.

50. The method of claim 42, wherein presenting a second signal representative of induction signals from the induction field source to the first hearing aid receiver to assist hearing in the first ear, and transmitting a third signal representative of the induction signals to a second hearing aid device to assist hearing in a second ear includes disconnecting power from a microphone system and connecting power to an induction signal receiver and a transmitter.

51. The method of claim 42, wherein the induction signals include induction signals produced by a voice coil in a telephone handset.

* * * * *